US008344996B2

(12) United States Patent
Lai et al.

(10) Patent No.: US 8,344,996 B2
(45) Date of Patent: Jan. 1, 2013

(54) LINE ADDRESSING METHODS AND APPARATUS FOR PARTIAL DISPLAY UPDATES

(75) Inventors: Jimmy Kwok Lap Lai, Vancouver (CA); Eric Jeffrey, Richmond (CA)

(73) Assignee: Seiko Epson Corporation, Tokyo (JP)

( * ) Notice: Subject to any disclaimer, the term of this patent is extended or adjusted under 35 U.S.C. 154(b) by 728 days.

(21) Appl. No.: 12/509,593

(22) Filed: Jul. 27, 2009

(65) Prior Publication Data

US 2011/0018857 A1 Jan. 27, 2011

(51) Int. Cl.
*G09G 3/34* (2006.01)

(52) U.S. Cl. ..... 345/107; 345/87; 345/94; 345/103; 345/204; 348/790; 348/792; 349/12; 349/33; 349/34

(58) Field of Classification Search ..... 345/84–108, 345/55, 204, 208–214; 348/790–792; 349/12, 349/33, 34

See application file for complete search history.

(56) References Cited

U.S. PATENT DOCUMENTS

| | | | | |
|---|---|---|---|---|
| 5,444,457 | A | 8/1995 | Hotto | |
| 5,627,558 | A | 5/1997 | Hotto | |
| 5,831,588 | A | 11/1998 | Hotto | |
| 6,054,974 | A * | 4/2000 | Sakai et al. | 345/98 |
| 7,079,103 | B2 * | 7/2006 | Morita | 345/98 |
| 7,728,832 | B2 | 6/2010 | Okamura | |
| 2002/0005832 | A1 * | 1/2002 | Katase | 345/107 |
| 2003/0020677 | A1 * | 1/2003 | Nakano | 345/87 |
| 2005/0285831 | A1 * | 12/2005 | Jones | 345/87 |
| 2006/0109235 | A1 * | 5/2006 | Hung et al. | 345/103 |
| 2006/0232547 | A1 * | 10/2006 | Johnson et al. | 345/107 |
| 2010/0309193 | A1 * | 12/2010 | Sun et al. | 345/214 |
| 2011/0001748 | A1 * | 1/2011 | Rutman et al. | 345/214 |

FOREIGN PATENT DOCUMENTS

| | | |
|---|---|---|
| JP | 2006-516747 | 7/2006 |
| JP | 2007-086584 | 4/2007 |
| WO | 2004066254 A1 | 8/2004 |

* cited by examiner

*Primary Examiner* — Lun-Yi Lao
*Assistant Examiner* — Gregory J Tryder

(57) ABSTRACT

A method for updating a submatrix of a display matrix of a display device comprises sequentially selecting rows of the display matrix starting from an initial row of the display matrix. The method includes determining whether a selected row precedes a first row of the submatrix in a first drive frame of a waveform having two or more drive frames. If a condition that a selected row precedes the first row of the submatrix in the first drive frame of the waveform is false, the method includes addressing the selected row for a first line address period. If a condition that a selected row precedes the first row of the submatrix in the first drive frame of the waveform is true, the method includes addressing the selected row for a second line address period.

21 Claims, 16 Drawing Sheets

LINE ADDRESSING METHODS AND APPARATUS FOR PARTIAL DISPLAY UPDATES

TECHNICAL FIELD

This application relates to driving a display device. More particularly, this application relates to the field of driving a display device that is updated in a plurality of drive frames.

BACKGROUND

An electro-optic material has at least two "display states," the states differing in at least one optical property. An electro-optic material may be changed from one state to another by applying an electric field across the material. The optical property may or may not be perceptible to the human eye, and may include optical transmission, reflectance, or luminescence. For example, the optical property may be a perceptible color or shade of gray.

Electro-optic displays include the rotating bichromal member, electrochromic medium, electro-wetting, and particle-based electrophoretic types. Electrophoretic display ("EPD") devices, sometimes referred to as "electronic paper" devices, may employ one of several different types of electro-optic technologies. Particle-based electrophoretic media include a fluid, which may be either a liquid, or a gaseous fluid. Various types of particle-based EPD devices include those using encapsulated electrophoretic, polymer-dispersed electrophoretic, and microcellular media. Another electro-optic display type similar to EPDs is the dielectrophoretic display.

Generally, an image is formed on an electro-optic display device by individually controlling the display states of a large number of small individual picture elements ("display pixels"). The one or more bits of data defining a particular display state of a display pixel may be referred to as a "data pixel." An image is defined by data pixels and may be referred to as a "frame." Commonly, the display pixels are arranged in rows and columns forming a matrix ("display matrix"). An exemplary electro-optic display pixel includes a layer of electro-optic material situated between a common electrode and a pixel electrode. One of the electrodes, typically the common electrode, may be transparent. The common and pixel electrodes together form a parallel plate capacitor at each display pixel, and when a potential difference exists between the electrodes, the electro-optic material situated in between the electrodes experiences the resulting electric field.

An electro-optic display may be of either the active or passive-matrix types. With active-matrix electro-optic displays, any particular display pixel in the display matrix may be addressed by driving a select signal on the row select line and simultaneously driving an optical-property-dependent signal on the column data line. However, in order to change the display state of a display pixel, particular types of display devices require driving the pixel electrode over time with a series of voltage pulses regularly spaced in time, i.e., the display pixels are driven with a waveform. The addressing of a particular display pixel in these display devices must be made in accordance with the timing requirements of the waveform used to change the display state of a display pixel. Accordingly, the use of an active-matrix electro-optic display device having display pixels driven with a waveform requires that the active-matrix addressing features be used in conformity with waveform timing requirements.

An electro-optic display device may have display pixels that have multiple stable display states. Display devices in this category are capable of displaying (a) multiple display states, and (b) the display states are considered stable. With respect to (a), display devices having multiple stable display states include electro-optic displays that may be referred to in the art as "bistable." The display pixels of a bistable display have first and second stable display states. The first and second display states differ in at least one optical property, such as a perceptible color or shade of gray. For example, in the first display state, the display pixel may appear black and in the second display state, the display pixel may appear white. In addition, display devices having multiple stable display states include devices having display pixels that have more than two stable display states. Each of the multiple display states differ in at least one optical property, e.g., light, medium, and dark shades of a particular color. As another example, a display device having multiple stable states may have display pixels having display states corresponding with 4, 8, 16, 32, or 64 different shades of gray.

With respect to (b), the multiple display states of a display device may be considered to be stable, according to one definition, if the persistence of the display state with respect to display pixel drive time is sufficiently large. The display state of a display pixel may be changed by driving a voltage on the display pixel until the desired appearance is obtained. Alternatively, the display state of a display pixel may be changed by driving a series of voltage pulses regularly spaced in time. In either case, the display pixel exhibits a new display state at the conclusion of the drive time. If the new display state persists for at least several times the minimum duration of the drive time, the new display state may be considered stable. Generally, in the art, the display states of display pixels of LCDs and CRTs are not considered to be stable.

An important advantage of electro-optic displays having multiple stable display states, in general, and EPD devices, in particular, is that once a display pixel has been placed in a particular display state, the display pixel will maintain that display state for a long period of time—at a minimum one or more minutes and up to hours, days, months, or longer—without drawing power. EPD devices need only be refreshed when a change in the appearance of the rendered image is desired or after the brightness of the rendered image diminishes below a desired level. In contrast, other types of display technologies maintain their display state for much shorter time periods. For example, the display pixels of a liquid crystal display ("LCD") maintain their optical appearance for less than a second. However, in comparison with other display technologies, such as LCDs, EPD devices require relatively long drive times to cause a display pixel to assume a new display state. Thus, changing an image rendered on an EPD device may take longer than desired.

Accordingly, there is a need for efficient methods and apparatus for updating an electro-optic display device having display pixels having multiple stable display states, each display pixel requiring a series of voltage pulses regularly spaced in time to change its display state.

SUMMARY OF DISCLOSURE

A method for updating a submatrix of a display matrix of a display device is disclosed. In one embodiment, the method comprises sequentially selecting rows of the display matrix starting from an initial row of the display matrix. The method includes determining whether a selected row precedes a first row of the submatrix in a first drive frame of a waveform having two or more drive frames. If a condition that a selected row precedes the first row of the submatrix in the first drive frame of the waveform is false, the method includes addressing the selected row for a first line address period. If a condition that a selected row precedes the first row of the submatrix in the first drive frame of the waveform is true, the method includes addressing the selected row for a second line address period.

In one embodiment, the method further comprises determining whether a selected row follows a final row of the submatrix in a final drive frame of the waveform. If a condition that a selected row follows a final row of the submatrix in a final drive frame of the waveform is false, the method includes addressing the selected row for a first line address period. If a condition that a selected row follows a final row of the submatrix in a final drive frame of the waveform is true, the method includes addressing a selected row for a second line address period.

In one embodiment, the method includes driving pixel data to one or more of the display pixels of the row while the row is being addressed if the selected row is addressed for the first line address period and the selected row is a row of the submatrix. The first line address period is a time period that is greater than the length of a drive pulse of the waveform. In one embodiment, the method includes depriving pixel data from the display pixels of the row while the row is being addressed if the selected row is addressed for the second line address period. The second line address period is a time period that is shorter than the length of a drive pulse of the waveform.

In one embodiment, the display device is active-matrix, electro-optic display device having display pixels having two or more stable display states, each display pixel requiring a series of voltage pulses regularly spaced in time to change its display state. A display controller and a display device are also disclosed.

In one embodiment, active-matrix, electro-optic display device includes a display matrix having a plurality of display pixels, each of the display pixels having two or more stable display states, each display pixel requiring a series of voltage pulses regularly spaced in time to change its display state. The display device includes a row driver, the row driver operable to receive any row address of the display matrix and to address a row of the display matrix corresponding with the received row address.

DETAILED DESCRIPTION

In the following detailed description of exemplary embodiments, reference is made to the accompanying drawings, which form a part hereof. In the several figures, like referenced numerals identify like elements. The detailed description and the drawings illustrate exemplary embodiments. Other embodiments may be utilized, and other changes may be made, without departing from the spirit or scope of the subject matter presented here. The following detailed description is therefore not to be taken in a limiting sense, and the scope of the claimed subject matter is defined by the appended claims.

Figure 1:
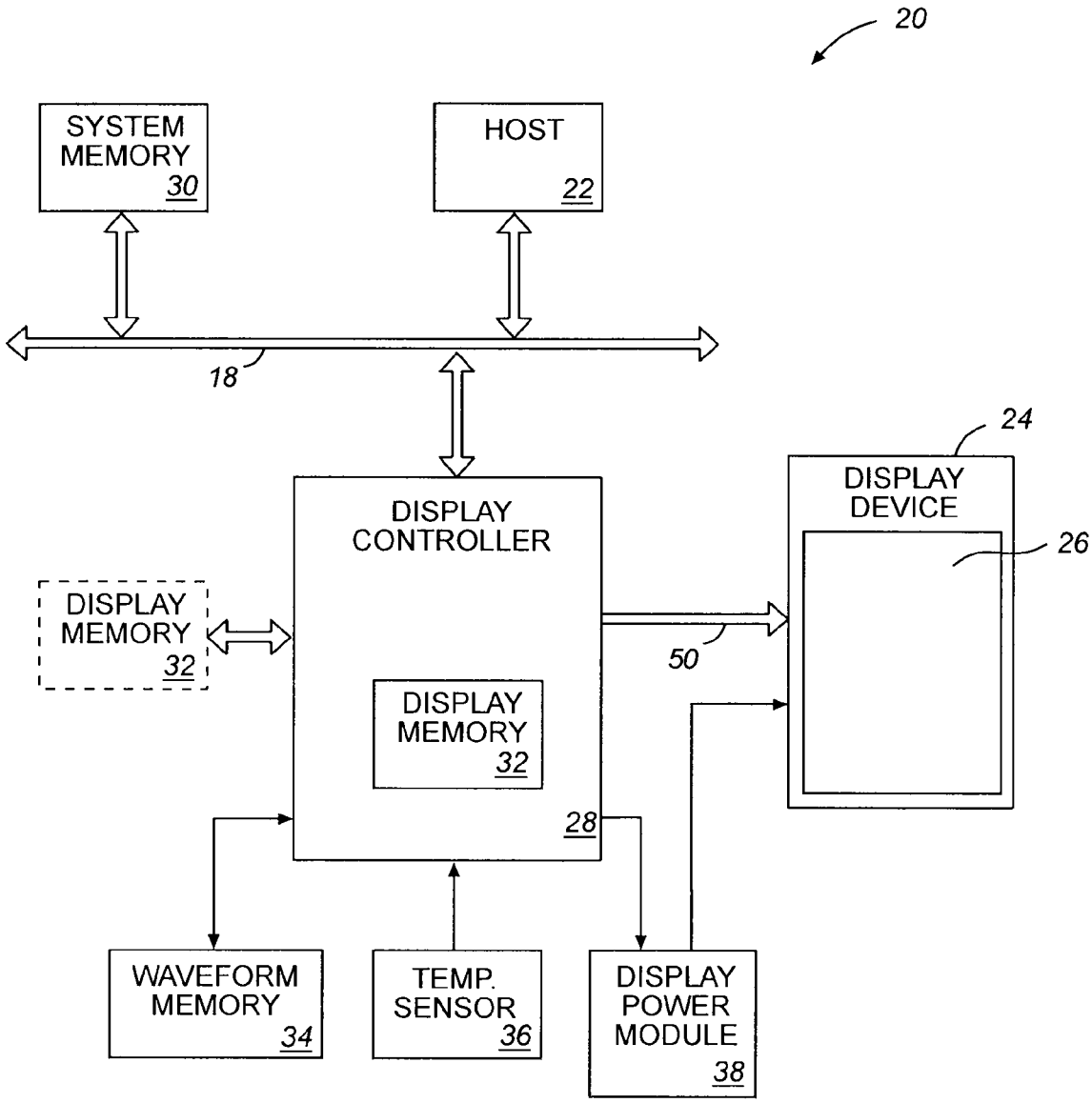
FIG. 1 is a block diagram of an exemplary display system having a display device, a display controller, and a display memory.

FIG. 1 illustrates a block diagram of an exemplary display system 20 illustrating one context in which embodiments may be implemented. Embodiments may be implemented in other contexts as well. The system 20 includes a host 22, a display device 24 having a display matrix 26, a display controller 28, and a system memory 30. The system 20 also includes a display memory 32, a waveform memory 34, a temperature sensor 36, and a display power module 38. In addition, the system 20 includes a first bus 18, a bus 50, as well as the shown buses interconnecting system components. The system 20 may be any digital system or appliance. In one embodiment, the system 20 is a battery powered (not shown) portable appliance, such as an electronic reader. FIG. 1 shows only those aspects of the system 20 believed to be helpful for understanding the disclosed embodiments, numerous other aspects having been omitted.

The host 22 may be a general purpose microprocessor, digital signal processor, controller, computer, or any other type of device, circuit, or logic that executes instructions of any computer-readable type to perform operations. Any type of device that can function as a host or master is contemplated as being within the scope of the embodiments.

In one embodiment, the display device 24 may be an electro-optic display device with display pixels having multiple stable display states in which individual display pixels are driven from a current display state to a new display state by series of two or more drive pulses. The display device 24 may be an active-matrix display device. In one embodiment, the display device 24 may be an active-matrix, particle-based electrophoretic display device having display pixels that include one or more types of electrically-charged particles suspended in a fluid, the optical appearance of display pixels being changeable by applying an electric field across the display pixels causing particle movement through the fluid.

In one embodiment, the display controller 28 may be disposed on an integrated circuit ("IC") separate from other elements of the system 20. In an alternative embodiment, the display controller 28 need not be embodied in a separate IC. In one embodiment, the display controller 28 may be integrated into or with one or more other elements of the system 20. The display controller 28 is further described below.

The system memory 30 may be may be an SRAM, VRAM, SDRAM, DDRDRAM, SDRAM, DRAM, flash, hard disk, or any other suitable memory. The system memory may store instructions that the host 22 may read and execute to perform operations. The system memory may also store data.

The display memory 32 may be an SRAM, VRAM, SDRAM, DDRDRAM, SDRAM, DRAM, flash, hard disk, or any other suitable memory. The display memory 32 may be a separate memory unit (shown in dashed lines), such as a separate IC, or it may be a memory embedded in the display controller 28, as shown in FIG. 1. In one alternative, the display memory 32 may be a combination of a separate memory and an embedded memory. The display memory 32 may be employed to store one frame of pixel data and one frame of synthesized pixel data. In one embodiment, the size of the display memory 32 is limited so as to be able to store only one frame of pixel data and one frame of synthesized pixel data. In one embodiment, the display memory 32 may store data or instructions.

The waveform memory 34 may be a flash memory, EPROM, EEPROM, or any other suitable non-volatile memory. In one embodiment, the memory 34 may be a volatile memory. The waveform memory 34 may store one or more different drive schemes, each drive scheme including one or more waveforms used for driving a display pixel to a new display state. The waveform memory 34 may include a two or more sets of waveforms, each set for use with a particular one of two or more update modes. The waveform memory 34 may include waveforms suitable for use at one or more temperatures. The waveform memory 34 may be coupled with the display controller 28 via a serial or parallel bus. In one embodiment, the waveform memory 34 may store data or instructions.

The waveform required to change the display state of a display pixel to a new display state may depend on temperature and other factors. To determine temperature, the temperature sensor 36 is provided. The temperature sensor 36 may be a digital temperature sensor with an integrated Sigma Delta analog-to-digital converter or any other suitable digital temperature sensor. In one embodiment, the temperature sensor 36 includes an $I^2C$ interface and is coupled with the display controller 28 via the $I^2C$ interface. The temperature sensor 36 may be mounted in a location suitable for obtaining temperature measurements that approximate the actual temperatures of the display pixels of the display device 24. The temperature sensor 36 may be coupled with the display controller 28 in order to provide temperature data that may be used in selecting a waveform.

The power module 38 is coupled with the display controller 28 and the display device 24. The power module 38 may be a separate IC. The power module 38 receives control signals from the display controller 28 and generates an appropriate voltage (or current) to drive selected display pixels of the display device. In one embodiment, the power management unit 38 may generate voltages of +15V, −15V, or 0V. When drive pulses are not needed, the power module 38 may be powered down or placed in a standby mode.

Figure 2:
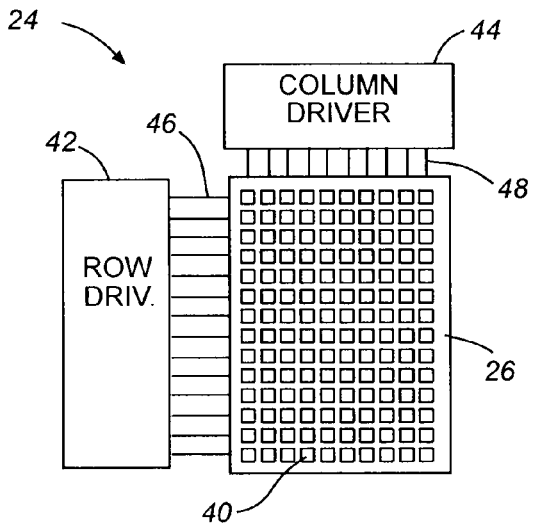
FIG. 2 is a schematic view of the display device of FIG. 1.

FIG. 2 is a schematic view of the display device 24 according to one embodiment. An image may be formed on the display device 24 by individually controlling the display states of a number of individual picture elements ("display pixels") 40. The display device 24 includes a display matrix 26 of display pixels 40. In one embodiment, each display pixel 40 includes an active switching element (not shown in FIG. 2), such as a thin-film transistor. The switching elements are addressed and driven by row driver 42 (which may also be referred to as a gate driver) and a column driver 44 (which may also be referred to as a source driver). The row or gate driver 42 may include an internal counter. A clock pulse (e.g., a vertical line shift clock) may be applied to the row driver 42. The clock pulse causes the row driver 42 to increment (or decrement) the internal counter. In one embodiment, the row driver 42 addresses (or selects) a row select line 46 corresponding with the count of the internal counter. Thus, by providing a sequence of clock signals, the row driver may be caused to address sequential row select lines 46. When the row driver 42 addresses one of the row select lines 46, it turns on all of the switching elements, e.g., all of the transistors in the corresponding row of the display matrix 26. While the row is addressed, the column driver 44 may provide drive pulses on one or more column data lines 48.

The display device 24 may be coupled with the display controller 28 via one or more buses 50 that the display controller uses to provide pixel data and control signals to the display device. The display state of a display pixel 40 is defined by one or more bits of data, which may be referred to as a "data pixel." An image is defined by data pixels and may be referred to as a "frame." Commonly, the display pixels are arranged in rows and columns forming a matrix ("display matrix") 26. There is a one-to-one correspondence between data pixels of a frame and the display pixels 40 of a corresponding display matrix 26.

Figure 3:
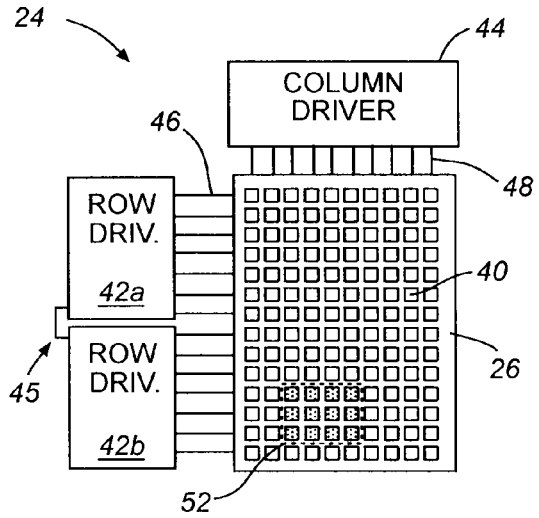
FIG. 3 is a schematic view of an alternative display device of FIG. 1.

FIG. 3 is a schematic view of the display device 24 according to one alternative embodiment. The display device 24 shown in FIG. 3 includes two row drivers 42*a* and 42*b*. In alternative embodiments, more than two row drivers may be employed. Two or more row drivers may be used if a display matrix 26 has more rows than a particular number of drive outputs available on a single row driver. Where two or more gate drivers are used, they may be cascaded in a daisy-chain wiring arrangement 45.

Figure 4:
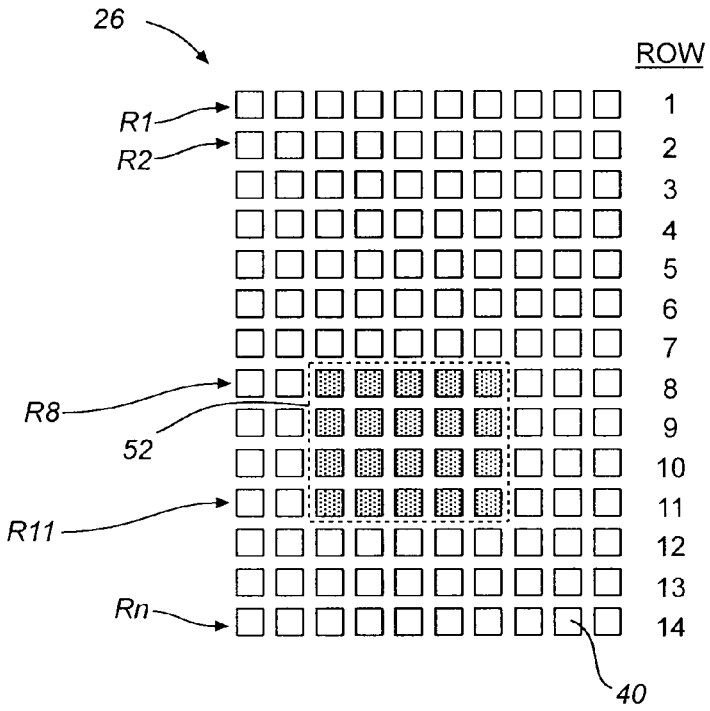
FIG. 4 is a schematic view of an exemplary display matrix 26 of display pixels of the display device of FIG. 1.

FIG. 4 shows a schematic view of an exemplary display matrix 26 of display pixels 40. The display device 24 includes a display matrix 26 of display pixels 40 for displaying a frame of pixel data. The display matrix 26 may include any number of rows and columns of display pixels. As one example, the display matrix includes 480 rows and 640 columns. The display matrix 26 includes a first row R1 and a last or final row Rn. The display matrix 26 may include one or more submatrices 52. The display submatrix 52 may be used in this description to refer to a region of the display matrix 26 that is refreshed or updated in a partial display update operation. The submatrix 52 includes a first row R8 and a last or final row R11. Each of the one or more submatrices 52 includes one or more display pixels that are to be refreshed or updated to a new display state. The display submatrix 52 may define any image such as, for example, a pop-up menu, a cursor, or a dialog box.

The display pixels 40 of the display matrix 26 of the display device 24 may have multiple stable states. In one embodiment, the display device 24 is a display device having display pixels 40 having three or more stable display states, each display state differing in at least one optical property. In one alternative embodiment, the display device 24 is a bistable display device having display pixels 40 which have first and second stable display states, each state differing from the other in at least one optical property. The display state of a display pixel 40 may be persistent with respect to drive time. In one embodiment, the display state of a display pixel 40 persists for at least two or three times the minimum duration of the drive time. In addition, in one embodiment, the voltage pulses required to change the display state of a display pixel 40 from a current display state to a new display state strongly depends on the current display state.

In one embodiment, the display device 24 includes a layer of electro-optic material situated between a common electrode and a pixel electrode. One of the electrodes, typically the common electrode, may be transparent. The common and pixel electrodes together form a parallel plate capacitor, and when a potential difference exists between the electrodes, the electro-optic material situated in between the electrodes experiences the resulting electric field.

Figure 5:
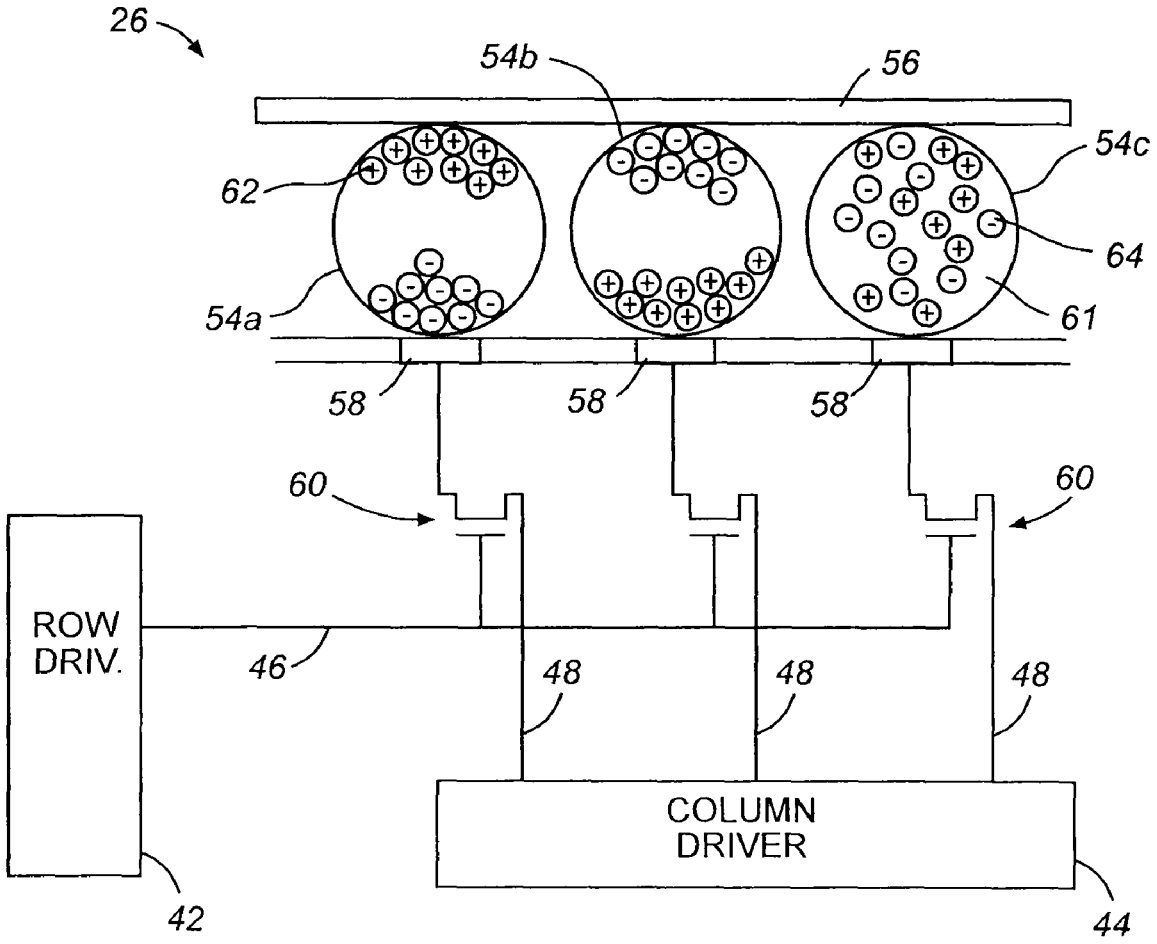
FIG. 5 is a diagram illustrating a portion of an exemplary display device.

FIG. 5 is a diagram illustrating one exemplary arrangement of one type of electrophoretic media disposed between a common electrode and a pixel electrode, one type of nonlinear circuit element of an active-matrix, and row and column driving circuits. In particular, FIG. 5 includes a simplified representation of a portion of the exemplary electrophoretic display 26 in cross-section, a schematic diagram of a portion of the associated nonlinear circuit elements, and a block diagram of row and column driving circuits 42, 44. Referring to FIG. 5, one or more microcapsules 54 are sandwiched between common electrode 56 and pixel electrodes 58. The common electrode 56 may be transparent. The drain terminals of thin-film transistors 60 are coupled with respective pixel electrodes 58. The gate terminals of the thin-film transistors 60 are coupled with the row driver 42 via a row select line 46. The source terminals of the thin-film transistors 60 are coupled with column driver 44 via respective column data lines 48. Each display pixel may correspond with one microcapsule 54 as shown in FIG. 5, or may correspond with two or more microcapsules (not shown). Each microcapsule 54 may include positively charged white particles 62 and negatively charged black particles 64 suspended in a fluid 61.

To change the display state of a display pixel 40, the common electrode 56 is placed at ground or some other suitable voltage and the row driver circuit 42 turns on all of the transistors 60 in one of the rows by driving a suitable voltage on the row select line 46. The turning on of all of the transistors in a particular row may be referred to herein as "addressing" or "selecting" the row. The column driver circuit 44 may then drive drive pulses on the column data lines 48 of display pixels having their display state changed. (If the display state of a particular display pixel 40 is not to be changed, the column driver circuit 44 need not drive a drive pulse on the column data line 48 of the particular display pixel.) As charge builds up on the common and pixel electrodes 56, 58 an electric field is established across the microcapsule(s) 54 associated with a particular display pixel. When the electric field is positive, the white particles 62 move toward the electrode 56, which results in the display pixel becoming whiter in appearance. On the other hand, when the electric field is negative, the black particles 64 move toward the electrode 56, which results in the display pixel becoming blacker in appearance. The microcapsule 54*a* is a simplified representation of a display pixel that is white and the microcapsule 54*b* is a simplified representation of a display pixel that is black. In addition, the microcapsule 54*c* illustrates a display pixel having a gray-scale value other than white or black, i.e., gray. The process of the row driver circuit 42 turning on all of the transistors 60 in one of the rows and the column driver circuit 44 then driving drive pulses on the column data lines 48 may be repeated at regularly spaced intervals for each drive pulse in a particular waveform.

So long as charge is stored on the common and pixel electrodes 56, 58 there will be an electric field across the display pixel causing particle movement through the fluid. It will be appreciated that even after the row driver circuit 42 turns a transistor 60 off, or the column driver circuit 44 stops driving a drive pulse on the column data line 48, charge may remain on the common and pixel electrodes 56, 58 for a period of time, i.e., the field does not instantly collapse or is sustained for a period by a capacitor. Moreover, the particles 62, 64 may have momentum. Accordingly, particle movement through the fluid may continue for some time after a display pixel has been driven with a drive pulse.

While the display state of a display pixel may be changed by having the column driver apply and hold an appropriate drive pulse on the column data line 48 until the desired display state is obtained in a single time interval, this has been found to be impractical and alternative methods are generally employed for changing the display state of a display pixel. One common alternative method provides for driving a series of drive pulses over time. In these methods, the display matrix 26 is refreshed or updated in a series of two or more "drive frames." For each drive frame in the series, each row is addressed once, allowing the column driver 44 to drive a drive pulse onto each display pixel of the addressed row having its display state changed. The duration of time that each row is addressed may be identical so that each drive frame in the series is of identical duration. Thus, instead of changing the display state of a display pixel with a single drive pulse in a single time period, the display state is generally changed by driving a series of drive pulses in a series of time periods regularly spaced in time according to a waveform.

Figure 6:
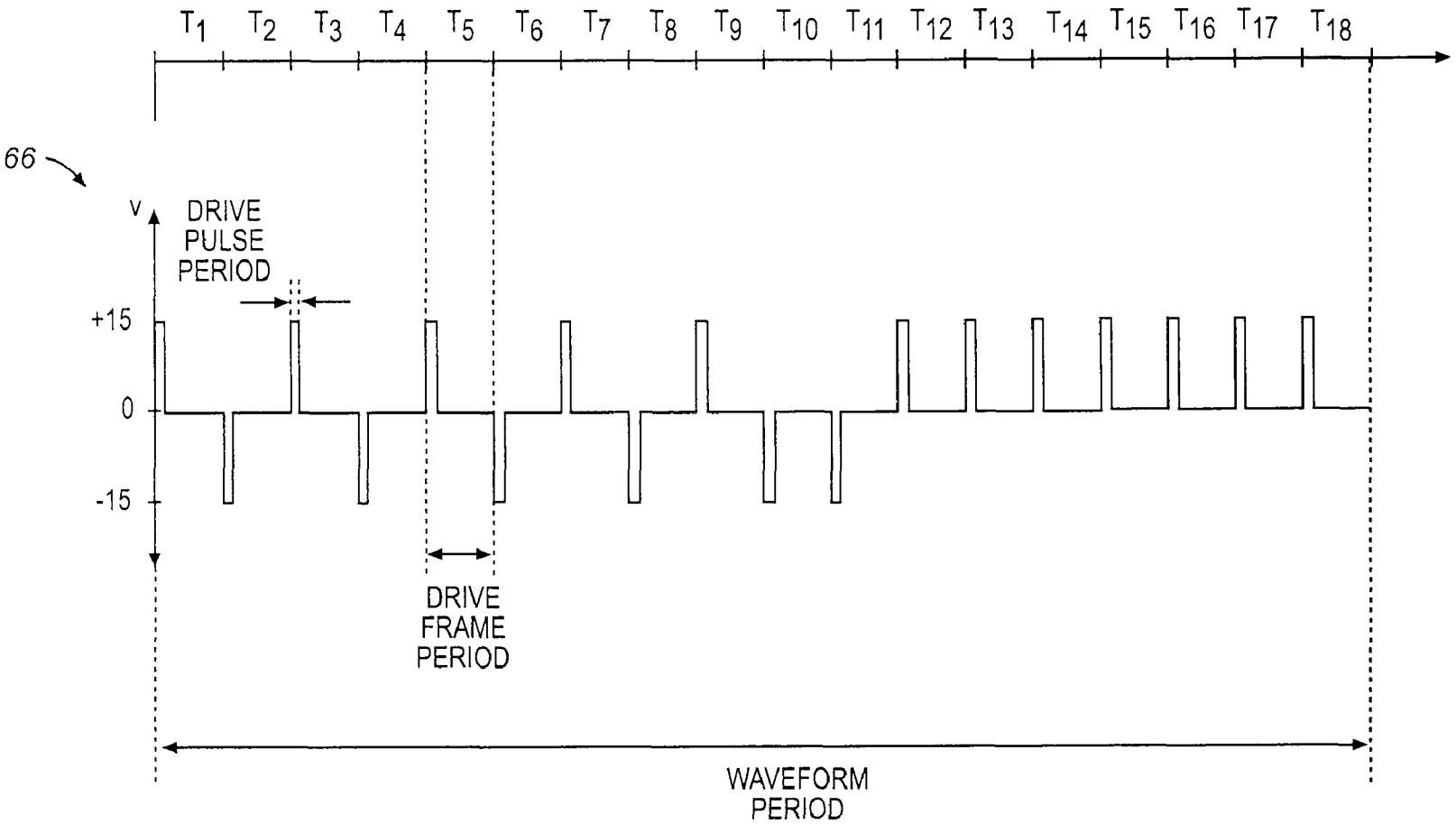
FIG. 6 illustrates an exemplary waveform that may be used to cause a display pixel of a display device to transition to a display state.

FIG. 6 shows an exemplary waveform 66. The term "waveform" may be used in this description to denote the entire series of drive pulses occurring in a series of time periods regularly spaced in time that are used to cause a transition from some initial display state to a final display state. A waveform may include one or more "pulses" or "drive pulses," where a pulse or a drive pulse generally refers to the integral of voltage with respect to time, but may refer to the integral of current with respect to time. The term "drive scheme" may be used in this description to refer to a set of waveforms sufficient to effect all possible transitions between display states for a specific display device under particular environmental conditions.

The waveform 66 is provided for the purpose of illustrating features of waveforms generally and for defining terms. The time period in which a single drive pulse is driven may be referred to as the "drive pulse period." In one embodiment, the drive pulse periods are of identical duration. The time period in which all of the lines of a display matrix 26 are addressed once may be referred to as the "drive frame period." In one embodiment, each drive frame period is of identical duration. The time associated with the entire series of drive frame periods may be referred to as the "waveform period." The "drive time" of a display pixel 40 may be equal to a waveform period.

The display device 24 may make use of multiple drive schemes. For example, the display device 24 may use a gray scale drive scheme ("GSDS"), which can be used to cause transitions between all possible gray levels. In addition, display device 24 may use a monochrome drive scheme ("MDS"), which can be used to cause transitions only between two gray levels, e.g., black or white. Further, the display device 24 may use a pen update mode ("PU"), which can be used to cause transitions having an initial state that includes all possible gray levels and a final state of either black or white.

Figure 7:
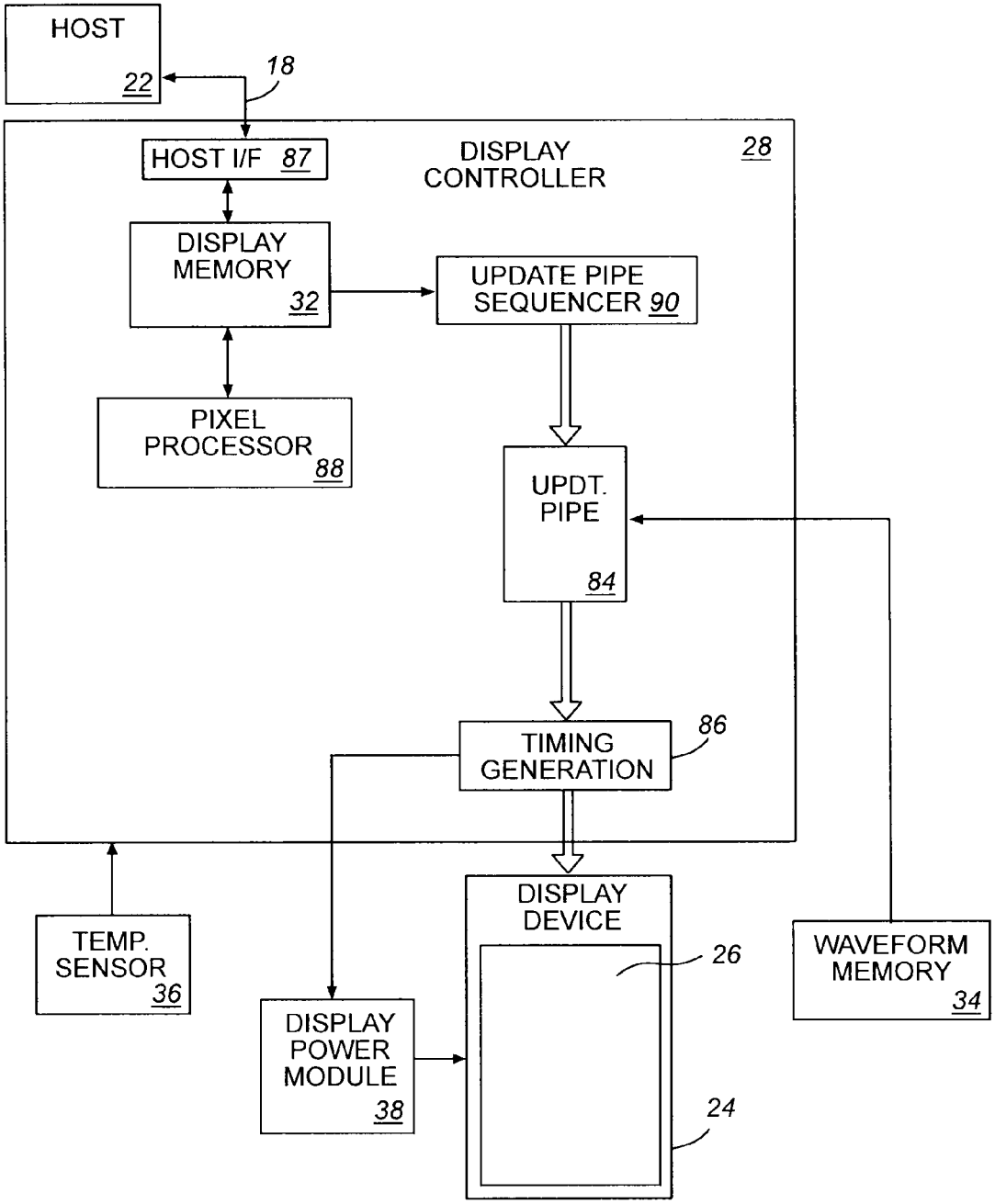
FIG. 7 is a block diagram of the display controller of FIG. 1.

FIG. 7 shows the display controller 28 in greater detail. The display controller 28 may include the display memory 32, an update pipe 84, a timing generation unit 86, a host interface 87, a pixel processor 88, and an update pipe sequencer 90. The display memory 32 may be coupled with the host 22 via the host interface 87. In addition, the display memory 32 may be coupled with pixel processor 88 and the update pipe sequencer 90. In an alternative embodiment, the display controller 28 may include a plurality of update pipes 84.

Figure 8:
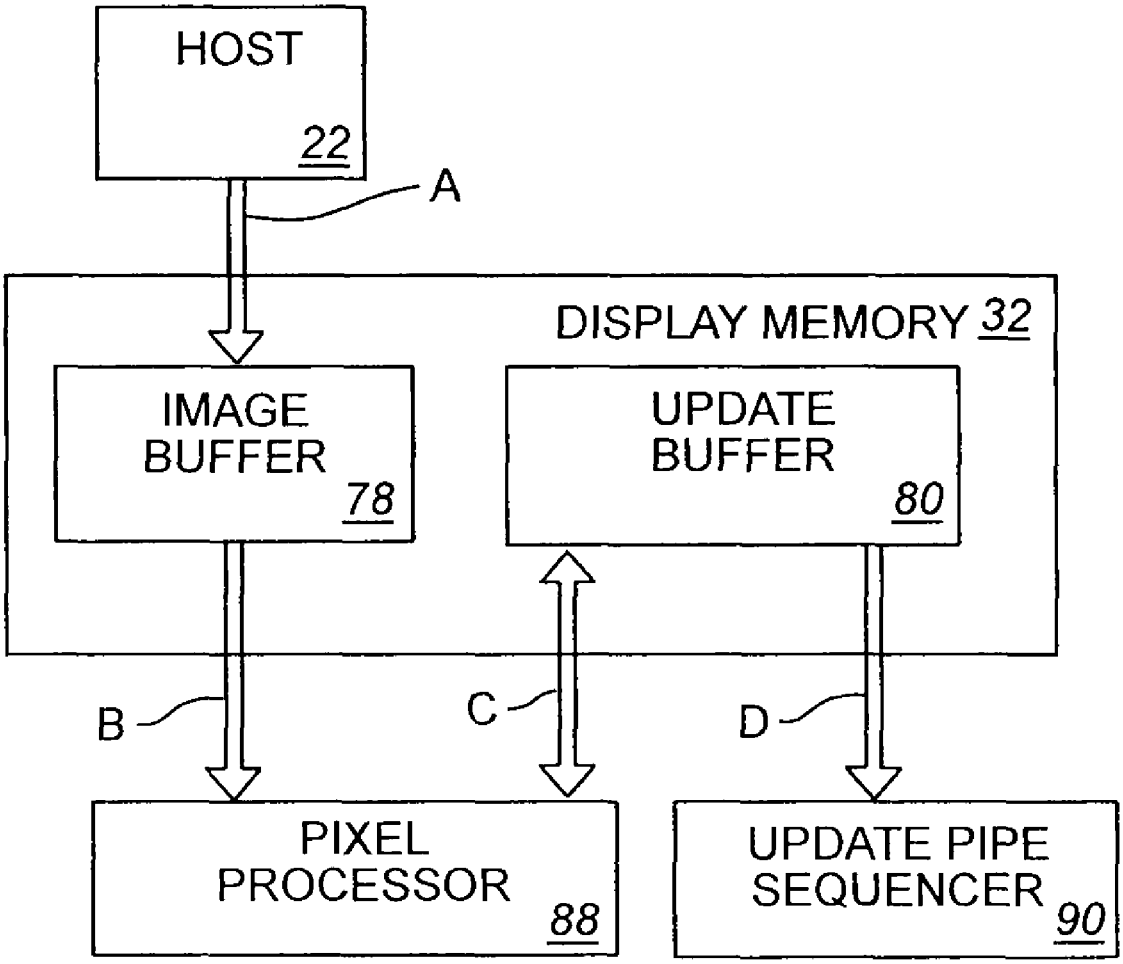
FIG. 8 is a block diagram of the display memory of FIG. 1 and exemplary data paths.

FIG. 8 is a block diagram showing the display memory 32, according to one embodiment, in greater detail, and exemplary data paths between the display memory 32 and the host 22, the pixel processor 88, and update pipe sequencer 90. In one embodiment, the display memory 32 includes an image buffer 78 and an update buffer 80. The host 22 may write to the image buffer 78 via data path "A." (Although not shown in FIG. 7, the host 22 may also read from the display memory 32.) In a pixel synthesis operation, the pixel processor 88 may read from the image buffer 78 via data path "B." In addition, the pixel processor 88 may read from and write to the update buffer 80 via data path "C." In a display update operation, the update pipe sequencer 90 may read from the update buffer 80 via data path "D."

The image buffer 78 may be used to store a frame of data pixels. The update buffer 80 may be used to store synthesized pixels. In one embodiment, a "synthesized pixel" is a data structure or a data record that defines a pixel transition. A synthesized pixel may include data defining a current display state and a next display state. In one embodiment, a synthesized pixel may additionally include an identifier of an assigned update pipe 84.

The host 22 may store a full frame of data pixels or a portion of a frame of data pixels in the image buffer 78 using data path A. Alternatively, another unit of the system 20 or the display controller 28 may store one or more data pixels in the image buffer 78. The pixel processor 88 is operable to generate synthesized pixels. The pixel processor 88 may read a data pixel stored in the image buffer 78 to obtain data defining a next display state of a display pixel 40 using data path B. The pixel processor 88 may read a synthesized pixel stored in the update buffer 80 to obtain data defining a current display state of a display pixel 40. The pixel processor 88 may read the synthesized pixel using data path C. The pixel processor 88 may use the data pixel obtained from the image buffer 78 and a synthesized pixel obtained from the update buffer 80 to generate a new synthesized pixel. The pixel processor 88 may store synthesized pixels that it generates in the update buffer 80 using data path C. The storing of a synthesized pixel in the update buffer 80 by the pixel processor 88 may overwrite a previously stored synthesized pixel. The update pipe sequencer 90 may fetch synthesized pixels from the update buffer 80 using data path D.

After data pixels 40 defining an image have been stored in the image buffer 78, a display update operation may be performed. A display update operation may be performed as a result of a display update command being sent, transmitted, or communicated to the display controller 28. The display update command may be sent by the host 22, by another device, or may be generated internally by the display controller 28. Generally, a display update command causes the display states of the display pixels 40 of the display matrix 26 to be updated. In response to the display update command, the display controller 28 performs: (a) a pixel synthesis operation; and (b) a display output operation. The display output operation generally includes multiple drive frame periods.

Figure 9:
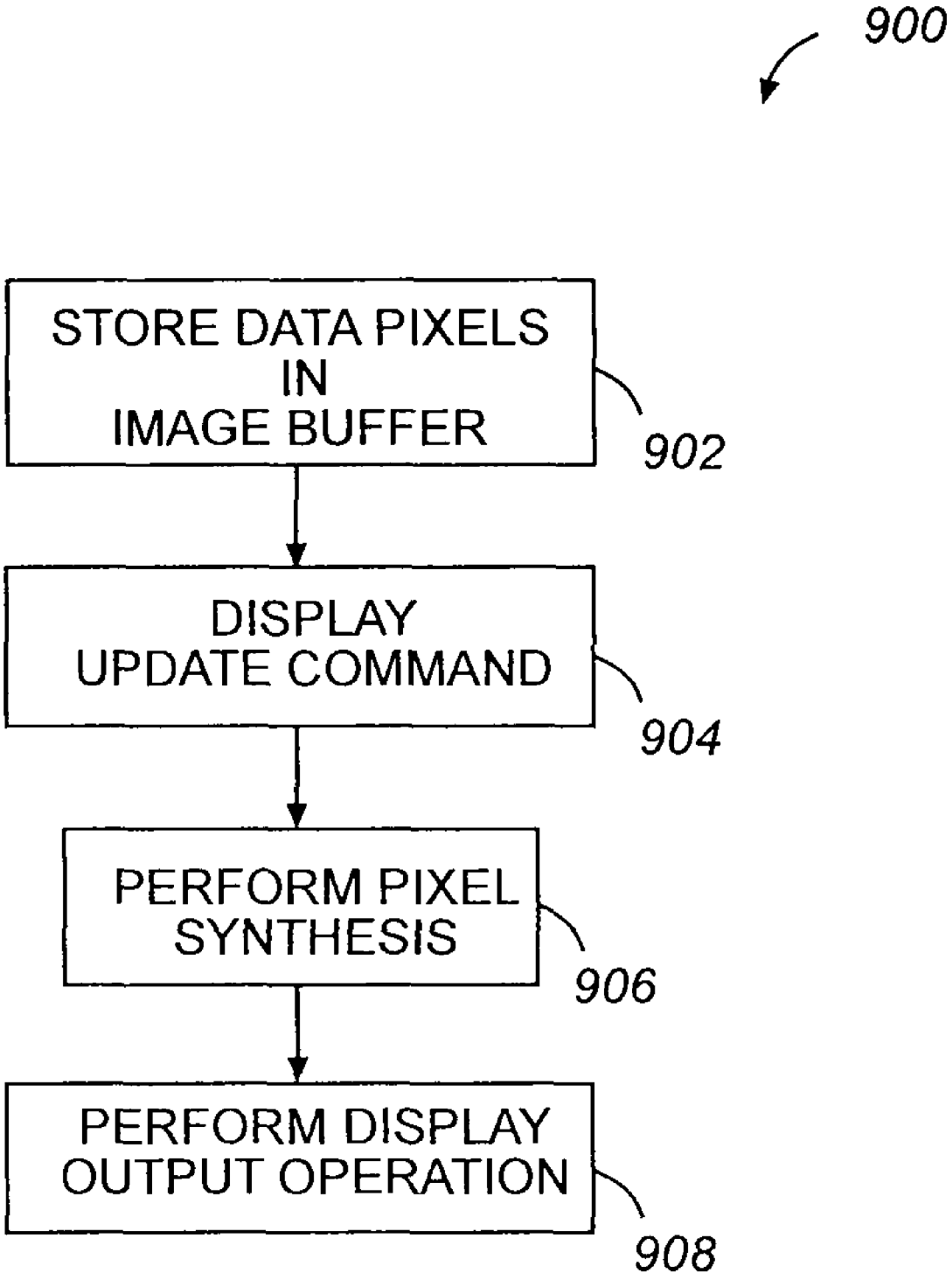
FIG. 9 is a flow diagram illustrating a process for displaying an image or updating a currently displayed image according to one embodiment.

FIG. 9 is a flow diagram illustrating a process 900 for displaying an image or updating a currently displayed image. In operation 902, data pixels are stored in the image buffer 78. In operation 904, a display update command is sent, received, or generated. In operation 906, a pixel synthesis operation is performed. In operation 908, a display output operation is performed. The pixel synthesis and display output operations are further described below.

Figure 10:
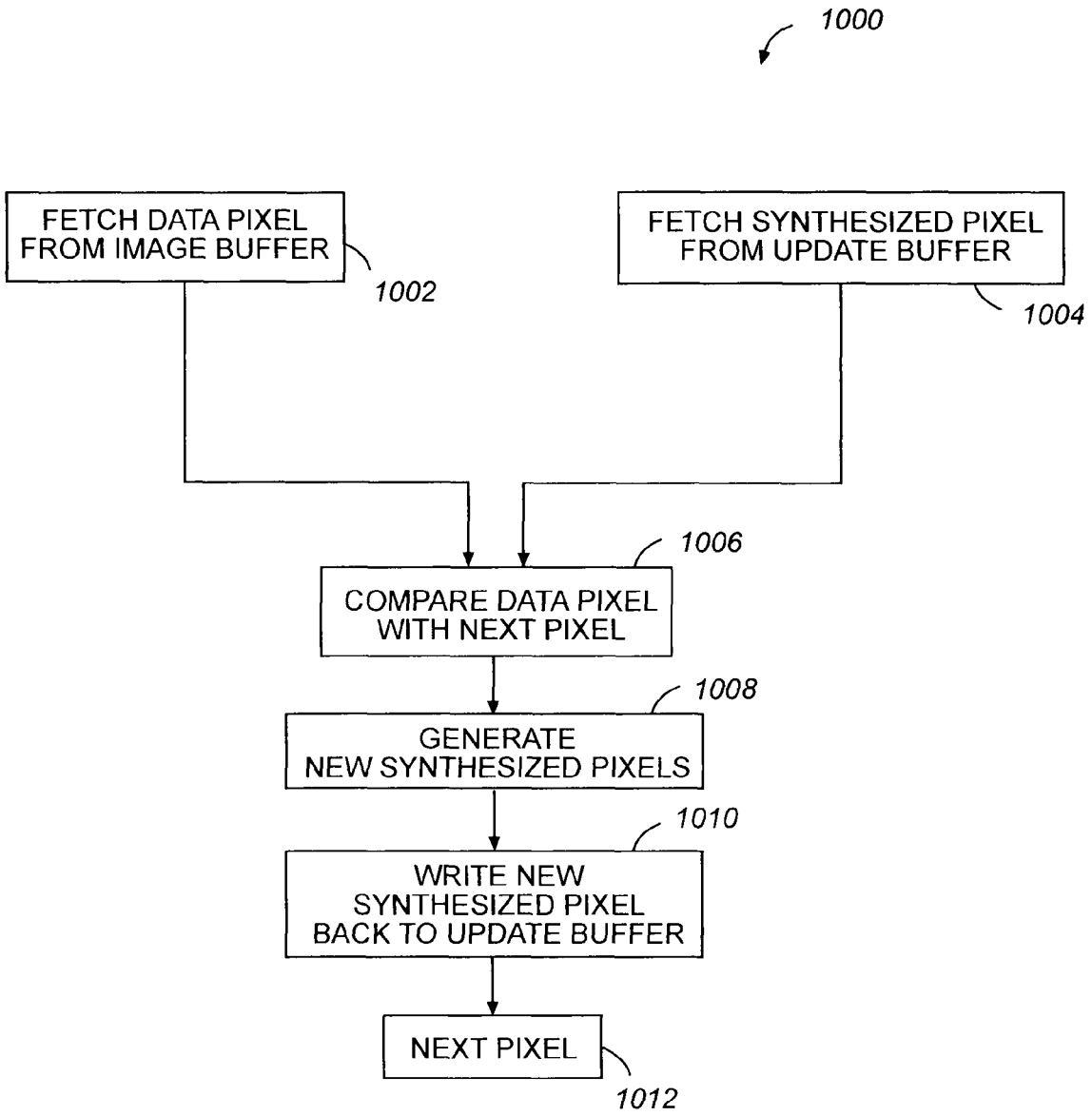
FIG. 10 is a flow diagram illustrating a pixel synthesis operation according to one embodiment.

FIG. 10 is a flow diagram illustrating a pixel synthesis operation 1000 according to one embodiment. The pixel synthesis operation 1000 may be performed by the pixel processor 88. In an operation 1002, a data pixel is read or fetched from the image buffer 78. Data pixels may be read from the image buffer 78 in raster order beginning with the data pixel 40 in the upper left corner of the display matrix 26 according to one embodiment. In an operation 1004, a synthesized pixel is read or fetched from the update buffer 80. Synthesized pixels may be read from the update buffer 80 in raster order beginning with the synthesized pixel corresponding with the data pixel in the upper left corner of the display matrix 26 according to one embodiment. The operation 1002 may be performed prior to the operation 1004, the operation 1004 may be performed prior to the operation 1002, or the operations 1002 and 1004 may be performed at the same time.

In operation 1006, the fetched data pixel is compared with a next pixel value. The next pixel value is obtained from the synthesized pixel fetched in operation 1004. A next pixel value is included in the data structure of each synthesized pixel and represents the current display state of a corresponding display pixel. Operation 1006 compares the data pixel and the next pixel value to determine if they are equal. If the values are equal, i.e., the next and current display states are identical, and the corresponding display pixel is not marked for updating. On the other hand, if the values differ, i.e., the next and current display states differ, and the corresponding display pixel is marked for updating.

In operation 1008, a new synthesized pixel may be formed or generated. If the display pixel was not marked for updating in operation 1006, a new synthesized pixel need not be formed. If the display pixel was marked for updating, the next pixel value obtained from the fetched synthesized pixel (operation 1004) is set as the current pixel value in the new synthesized pixel. The value of the fetched data pixel (operation 1002) is set as the next pixel value in the new synthesized pixel. In operation 1010, the new synthesized pixel is written back to the update buffer 80. As indicated by operation 1012, the pixel synthesis operation 1000 repeats operations 1002-1010 for each pixel location in the display matrix 26 according to one embodiment.

Figure 11:
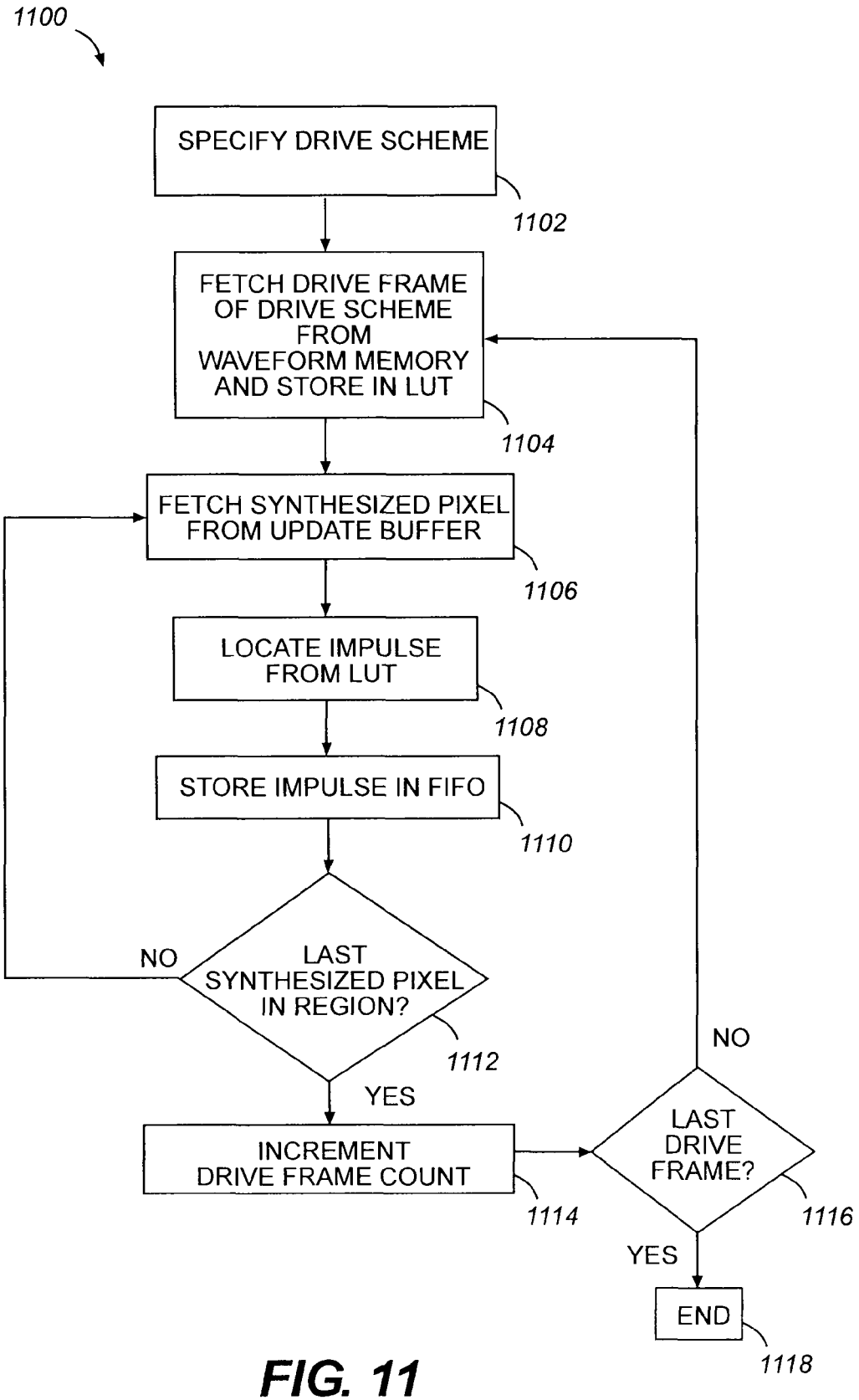
FIG. 11 is a flow diagram illustrating an operational flow for storing drive pulse data in an update pipe according to one embodiment.

FIG. 11 is a flow diagram illustrating an operational flow 1100 for storing drive pulse data in an update pipe 84 according to one embodiment. A display output operation includes the operational flow 1100. In an operation 1102, an update mode or drive scheme is specified, e.g. GSDS, MDS, PU, etc. The drive scheme may be specified as part of a display update command. In operation 1104, drive pulses of a drive frame of a drive scheme are fetched from the waveform memory 34. The fetched drive pulses correspond with a particular drive frame of the specified drive scheme and a current temperature. All possible drive pulses for the drive scheme of the current drive frame may be stored in a lookup table ("LUT") associated with the update pipe 84.

In operation 1106, a synthesized pixel is fetched from the update buffer 80. In operation 1108, a drive impulse is located for the fetched synthesized pixel. The current and next display states of a synthesized pixel are used to locate drive pulse data in the LUT. In operation 1110, the located drive pulse data is stored in a first-in-first-out memory ("FIFO") memory, which may be included within the update pipe.

In operation 1112, a determination is made if the current synthesized pixel corresponds with the last pixel location in an update region. The update region may be the display matrix 26, or one or more submatrices 52. If not the last pixel location, operations 1106-1110 are repeated for each additional synthesized pixel in the update region. If the current synthesized pixel is the last synthesized pixel, a drive frame count is incremented in operation 1114. In operation 1116, a determination is made whether the current drive frame is the last drive frame of the drive scheme. If it is not the last drive frame period, operations 1104-1112 are repeated for each remaining drive frame period of the drive scheme. If it is the last drive frame period, the display pixels of the update region have completed their transition to new display states and the operational flow ends.

In addition to the operational flow 1100, a display output operation includes providing drive pulse data stored in an update pipe 84 to the display device 24 and display power module 38. Referring again to FIG. 7, the timing generation unit 86 may fetch drive pulse data stored in an update pipe 84 and provide fetched drive pulse data to the display device 24 and display power module 38 in a display output operation. The timing generation unit 86 includes an input that is coupled an output of the update pipe 84. The timing generation unit 86 provides waveform data to the display power module 38 and the display device 24 according to the timing requirements of the waveform and the display device 24.

Turning now to aspects of required timing requirements and referring again to FIG. 6, a waveform generally includes multiple drive frame periods. In a drive frame period, all of the rows of the display matrix 26 are typically addressed row-by-row, beginning with the top or sometimes the bottom row. Referring again to FIG. 4, the row driver 42 sequentially addresses rows of display pixels, starting with an initial row, of the display matrix 26, e.g. the first row R1. While the row is addressed, a drive pulse is driven on respective column data lines 48 to one or more display pixels 40 in the addressed row by the column driver 44, the drive pulses being driven to one or more display pixels 40 undergoing a display state change. After an interval known as a "line address period," the row driver 42 stops addressing the initial row, i.e. the row driver turns of all of the transistors or switching elements of the first row. A next sequential row, e.g., row R2 is then addressed and drive pulses are placed on the column data lines 48 so that display pixels of row R2 are driven. This process is repeated until row Rn is addressed and the entire display matrix is written in a row-by-row manner.

With known waveforms, each line address period is typically of the same duration. In addition, the drive pulse periods are typically identical and of a duration that is less than or equal to the line address period. As one example, the display matrix may include 480 rows of 640 pixels, the frame period may be 20 milliseconds, and the line address period may be 41.7 microseconds.

Known waveforms may require that drive pulses be spaced apart in time to allow for particle movement in the fluid. Consider a series of drive pulses that are provided to a display matrix 26 having n lines in a series of line address periods, the addressing of each line being temporally separated by at least n−1 line address periods. For example, a display matrix 26 may have 480 lines. Each line address period may be temporally separated by at least 479 line address periods. If the line address period is 41.7 microseconds, the time between addressing any particular line will be 479×41.7 microseconds=20 milliseconds. As mentioned above, particle movement through the fluid may continue after the driving voltage pulse finishes. Accordingly, particle movement associated with the driven display pixel may continue for up to 20 milliseconds after the display pixel has been driven with a drive pulse. If drive pulses are not spaced apart by the appropriate time interval, e.g., 20 milliseconds, the display pixels may not be driven to desired display state in a satisfactory manner. Accordingly, for at least this reason, it is important that timing requirements associated with a particular waveform be followed.

An image may be rendered on the display matrix 26 by causing each of the display pixels 40 to take on a particular display state. Generally, once an initial image is rendered on the display matrix 26, two types of changes are made to the image. The entire image may be changed or one or more parts of the image may be changed. If the update region is the entire display matrix 26, the display update operation is a "full display update." If the update region is one or more submatrices 52, the display update operation is a "partial display update." In a partial display update, the display pixels of the display matrix 26 that are not included in a submatrix 52 are not changed.

According to known methods, frame periods and line address periods of a particular waveform may be the same regardless of whether a full or partial update is performed. Thus, beginning with the first row R1 of the display matrix 26, each row is addressed in turn for a specified line address period regardless of whether a full or partial update is being performed. In the case of a partial display update, when a row outside of the submatrix 52 is addressed, the display pixels of the row are deprived of pixel data by the column driver 44. For example, referring to FIG. 4, when the rows R1-R7 and R12-R14 are addressed during a partial display update, these rows are deprived of pixel data.

Figure 12:
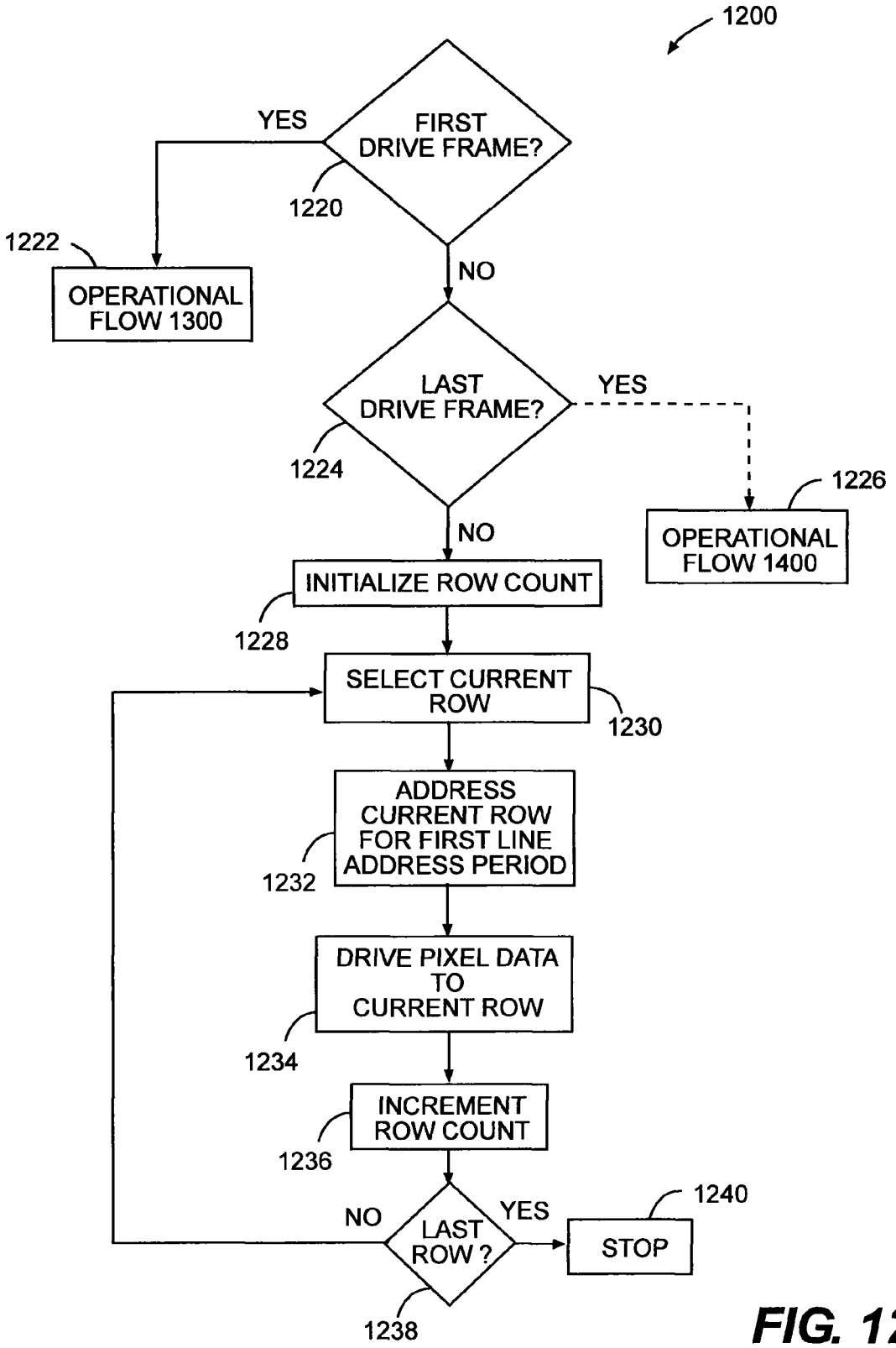
FIG. 12 is a flow diagram for providing waveform data to a display power module and a display device in a partial display update according to one embodiment.

FIG. 12 is a flow diagram for providing waveform data to the display power module 38 and the display device 24 in a partial display update according to one embodiment. In an operation 1220, it is determined if a current drive frame is the first drive frame of a particular waveform. If the current drive frame is the first drive frame of a waveform, the flow proceeds to operation 1222; otherwise, the flow proceeds to operation 1224. In operation 1222, an operational flow 1300 described below is performed. In operation 1224, it is determined if a current drive frame is the final or last drive frame of the particular waveform. If the current drive frame is the final drive frame of a waveform, the flow proceeds to operation 1226; otherwise, the flow proceeds to operation 1228. In operation 1226, an operational flow 1400 described below is performed.

In operation 1228, a row count is initialized. In operation 1230, a "current row" is selected. The current row corresponds with a row count value. In operation 1232, a first signal is provided to the display device 24. In response to the first signal, the display device 24 addresses a row of the display matrix 26 corresponding with the currently selected row. In addition, in response to the first signal, the display device 24 addresses the row for a first line address period. The first line address period may be a time period greater than or equal to the length of the drive pulses of a particular waveform. The first line address period may be a time period prescribed by a particular waveform. In operation 1234, a second signal is provided to the display power module 38. In response to the second signal, the display power module 38 provides pixel data in the form of a drive impulse to one or more display pixels of the currently addressed row of the display matrix 26 via the column driver 44. In an operation 1236, a count of selected rows of the display matrix 26 is incremented. An operation 1238 determines if the incremented count exceeds the number of rows of the display matrix 26. If the count does not exceed the number of rows of the display matrix 26, the flow 1200 proceeds to operation 1230, where a current row is selected. On the other hand, if the count exceeds the number of rows of the display matrix 26, the flow 1200 proceeds to an operation 1240, where the exemplary operational flow 1200 for a display frame is stopped.

Figure 13:
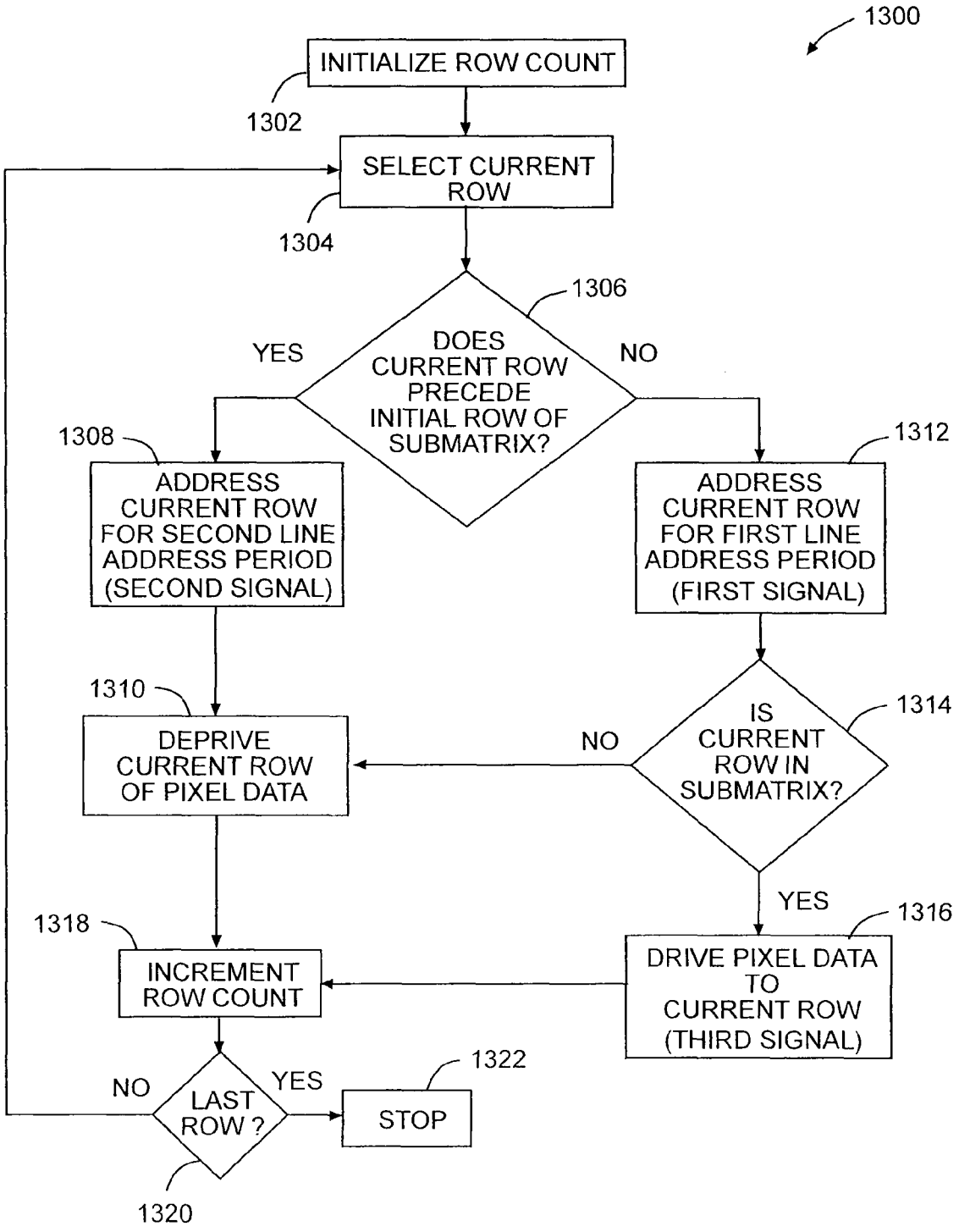
FIG. 13 illustrates an exemplary operational flow for providing waveform data to a display power module and a display device in a first drive frame of a partial display update according to one embodiment.

FIG. 13 illustrates an exemplary operational flow 1300 for providing waveform data to the display power module 38 and the display device 24 in a first drive frame of a partial display update according to one embodiment. In the exemplary flow 1300, the partial display update is performed on a submatrix 52. In an operation 1302, a row count is set to an initial value. In operation 1302, the row count is initialized so that row selecting starts from an "initial" row. In one embodiment, the initial row is a first row of the display matrix 26, e.g. row R1 (see FIG. 4). The initial row may also be a bottom row of the display matrix, e.g. row Rn. In one alternative embodiment, the initial value is set to a first row of the submatrix 52, e.g. row R8 (see FIG. 4). In an alternative, the initial row may be a bottom row of the submatrix 52, e.g. row R11. In one embodiment, the operation 1302 may include specifying an initial row or line of a display matrix. In one embodiment, the display controller 28 is operable to provide a particular row address to a display device, the particular row address defining an initial row or line.

In an operation 1304, the row corresponding with the row count is selected, that is a row identified as a current row is selected. As the count is repeatedly incremented (operation 1318) after initialization, each row of the display matrix following the initial row is sequentially selected according to the flow 1300. If the initial row is set to the first row of the display matrix, each row of the display matrix following the first row of the display matrix will be selected, i.e., rows R1-Rn of the display matrix 26 will be selected. On the other hand, if the initial row is set to the first row of the submatrix 52, rows R8-Rn of the display matrix will be selected, and rows R1-R7 will not be selected in the first drive frame.

An operation 1306 determines whether the currently selected row precedes the first row address of the submatrix 52, e.g. row R8. If the currently addressed row precedes the first row address of the submatrix 52, an operation 1308 is performed. On the other hand, if the currently addressed row follows the first row address of the submatrix 52, an operation 1312 is performed.

In operation 1312, a first signal may be provided to the display device 24. In response to the first signal, the display device 24 addresses a row of the display matrix 26 corresponding with the currently selected row. In addition, in response to the first signal, the display device 24 addresses the row for a first line address period. As mentioned above, the first line address period may be a time period greater than or equal to the length of the drive pulses of a particular waveform. The first line address period may be a time period prescribed by a particular waveform.

In operation 1308, a second signal may be provided to the display device 24. In response to the second signal, the display device 24 addresses a row of the display matrix 26 corresponding with the currently selected row. In addition, in response to the second signal, the display device 24 addresses the row for a second line address period. In contrast to the first line address period, the second line address period may be a time period that is shorter than the length of the drive pulses of a particular waveform. For example, if the first line address period is 41.7 microseconds (24 k Hz), the second line address period may be 10 microseconds (100 k Hz). The duration of the second line address period may be determined based on the maximum input frequency of a row driver.

An operation 1310 is performed after the operation 1308 has begun. In operation 1310, pixel data is deprived from the display pixels of the current row while it is addressed. If the currently addressed row precedes the initial row address of the submatrix 52, pixel data is deprived from the display pixels of the current row while the row is addressed for the second line address period.

An operation 1314 is performed after the operation 1312 has begun. In operation 1314, it is determined whether a currently selected row is within a submatrix 52. If it is determined that a currently selected row is within the submatrix 52, an operation 1316 is performed. On the other hand, if it is determined that a currently selected row is not within the submatrix 52, the operation 1310 is performed.

The operation 1316 may be performed after the operation 1312 has begun and after the operation 1314. In operation 1316, a third signal may be provided to the display power module 38. In response to the third signal, the display power module 38 provides pixel data in the form of a drive impulse to one or more display pixels of the currently addressed row of the display matrix 26 via the column driver 44. Drive pulses are driven to one or more of the display pixels of the current row while the row is addressed for the first line address period.

The operation 1310 may be performed after the operation 1312 has begun and after the operation 1314. In operation 1310, pixel data is deprived from the display pixels of the current row while it is addressed. If the currently addressed row does not precede the initial row address of the submatrix 52, pixel data is deprived from the display pixels of the current row while the row is addressed for the first line address period.

In an operation 1318, a count of selected rows of the display matrix 26 is incremented. An operation 1320 determines whether the incremented count exceeds the number of rows of the display matrix 26. If the count does not exceed the number of rows of the display matrix 26, then the flow 1300 proceeds to operation 1304, where a current row is selected. On the other hand, if the count exceeds the number of rows of the display matrix 26, then the flow 1300 proceeds to an operation 1322, where the exemplary operational flow 1300 for a first display frame is stopped.

When the operational flow 1300 is employed, the first drive frame period of a waveform will be shorter than subsequent drive frame periods of the waveform. The first drive frame will be comprised of back-to-back, shortened second line address periods followed by standard length first line address periods. As one example, referring to FIG. 4, the first drive frame would be comprised of seven shortened second line address periods (rows R1-R7) followed by seven standard first line address periods (rows R8-R14).

As another example, consider a display matrix 26 having 480 lines and a submatrix 52 having a first row address of line 240. Further assume that the first line address period is 41.7 microseconds and the second line address period is 10 microseconds. In this example, the first drive frame will take 12.4 milliseconds ([240 lines×10 microseconds]+[240 lines×41.7 microseconds]). Drive frames following the first drive frame will take 20 milliseconds (480 lines×41.7 microseconds). The first drive frame would also take 20 milliseconds if the operational flow 1300 were not employed. Thus, in this example, use of the operational flow 1300 results in the first drive frame being 7.62 milliseconds (20−12.4) shorter than a first drive frame not employing the operational flow 1300.

From the foregoing examples, it can be seen that one feature of the disclosed embodiments is that the time to perform a partial update may be shorter when the operational flow 1300 is used than when it is not used. Shortening the time to perform a partial update allows a completed partial update to be viewed sooner than when the operational flow 1300 is not used. Another feature is that the partial update may begin sooner than when the operational flow 1300 is not used. During a waveform period the appearance of display pixels is not static. As soon as the pulses of first drive frame are applied, particle movement in the fluid 60 may begin as the display pixels 40 of the submatrix 52 begin their transition to a new display state. While the image rendered on the display device 24 during the transition period is imperfect, it may be perceptible to the human eye. Starting a partial update sooner than when the operational flow 1300 is not used allows changes in appearance of the image due to initial particle movement to be viewed sooner, providing visual feedback.

Note the operational flow 1300 assumes a single submatrix 52. The operational flow 1300 may be modified to accommodate plural submatrices 52 by, for example, altering operation 1306 to determine whether the current row precedes a first row of a first submatrix 52.

In one alternative, the first row of a submatrix 52 may be a side-edge, vertical row. In this alternative, it is contemplated that the usual roles of the row and column drivers is reversed. That is, individual columns are selected by a column driver and pixel data is driven or not driven by a row driver.

In alternative embodiments, in operation 1316, pixel data may be withheld from a currently selected row, or pixel data may not be driven to the display pixels of a currently selected row.

Note that the operational flow 1300 is generally only performed on a first drive frame of two or more drive frames; the operational flow 1300 is generally not performed on drive frames after the first drive frame. However, in one embodiment, the line addressing of a final drive frame of a sequence of two or more drive frames may be modified.

Figure 14:
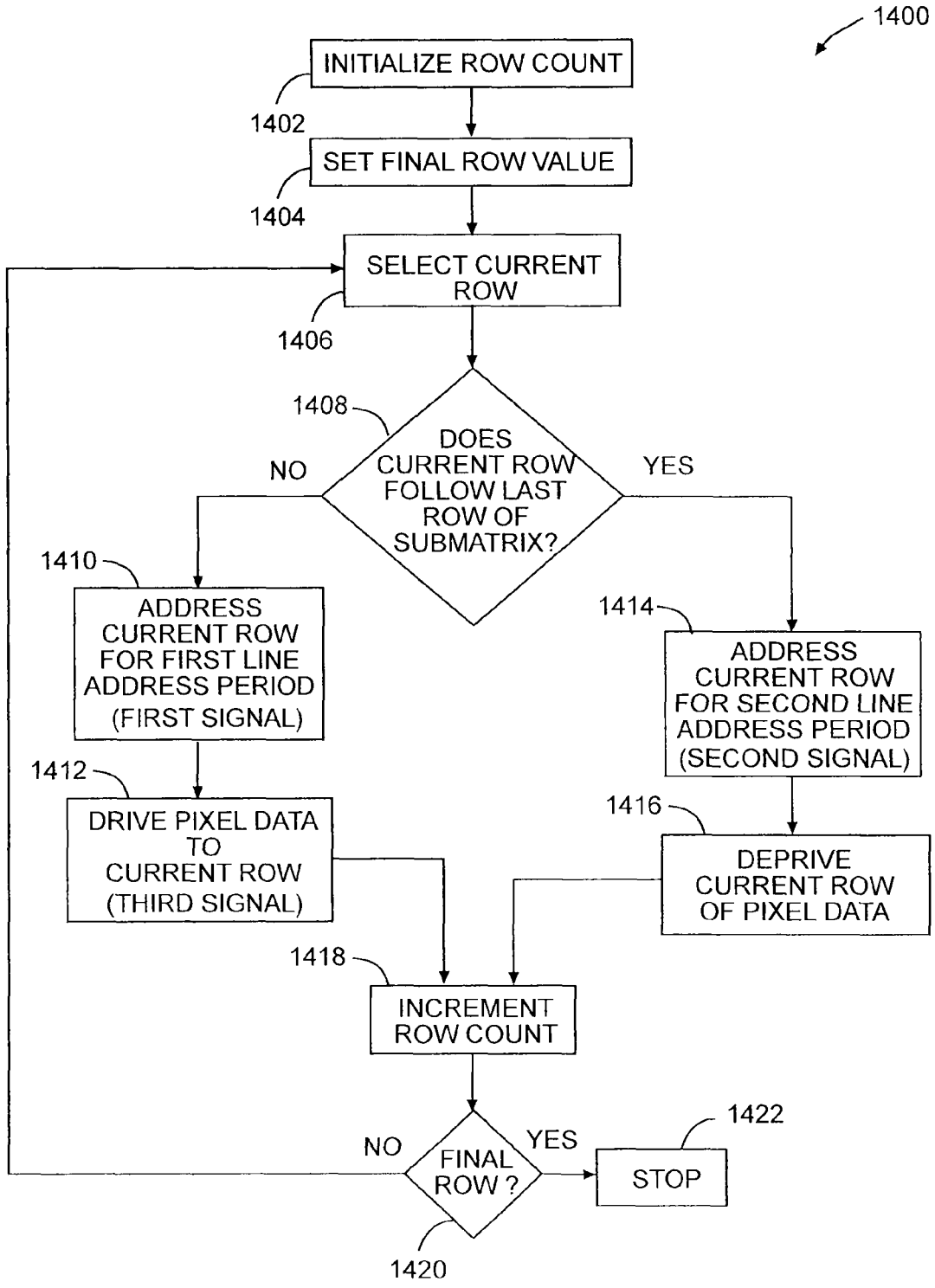
FIG. 14 illustrates an exemplary operational flow for providing waveform data to a display power module and a display device in a final drive frame of a partial display update according to one embodiment.

FIG. 14 illustrates an exemplary operational flow 1400 for providing waveform data to the display power module 38 and the display device 24 in a final drive frame of a partial display update according to one embodiment. In the exemplary flow 1400, the partial display update is performed on a submatrix 52. In one embodiment, the lines following the last line of the submatrix 52 are not selected in a final drive frame. In an alternative embodiment, the lines following the last line of the submatrix 52 are selected for the second line address period in a final drive frame instead of being selected for the first line address period. In one embodiment, the initial row is a first row of the display matrix 26, e.g. row R1 (see FIG. 4). The initial row may also be a bottom row of the display matrix, e.g. row Rn. In one alternative embodiment, the initial value is set to a first row of the submatrix 52, e.g. row R8 (see FIG. 4). In an alternative, the initial row may be a bottom row of the submatrix 52, e.g. row R11.

In an operation 1402, a row count is initialized so that row selecting starts from a "current" row. The current row may be a first or initial row. The first row may be a top row R1 or a bottom row Rn. In one embodiment, the operation 1402 may include specifying an initial row or line of a display matrix. In an operation 1404, a final row value of the display matrix 26 may be set for the purpose of setting a maximum count value. The final row value may also be set to the last row of the submatrix 52, e.g. row R11 of the submatrix 52 of FIG. 4. In addition, the final row value may also be set to the last row of the submatrix 52 for the case of counting from the bottom of the display matrix. Alternatively, the final row value may be set to the last row Rn of the display matrix 26 or to the first row R1 of the display matrix 26.

In an operation 1406, a row corresponding with the row count is selected, i.e., a row identified as a current row is selected. As the count is repeatedly incremented (operation 1418) after the initialization operations, each row of the display matrix following the initial row may be sequentially selected according to the flow 1400. If the initial row is set to the first row of the display matrix 26, and the final row value is set to the last row Rn of the display matrix 26, then each row of the display matrix following the first row of the display matrix will be selected, i.e., rows R1-Rn of the display matrix 26 will be selected. On the other hand, if the initial row is set to the first row of the display matrix 26, and the final row value is set to the last row of the submatrix 52, then rows R1-R11 of the display matrix will be selected, and rows R12-R14 will not be selected in the final drive frame (see FIG. 4).

An operation 1408 determines whether the currently selected row follows a final row of the display matrix 26. For example, in the exemplary display matrix shown in FIG. 4, the row 11 is the final row of the submatrix 52. If it is determined in operation 1408 that a currently selected row does not follow the final row of the display matrix 26, an operation 1410 is performed. On the other hand, if it is determined in operation 1408 that a currently selected row follows the final row of the display matrix 26, an operation 1414 is performed.

In the operation 1410, a first signal is provided to the display device 24. In response to the first signal, the display device 24 addresses a row of the display matrix 26 corresponding with the currently selected row. In addition, in response to the first signal, the display device 24 addresses the selected row for a first line address period. As mentioned above, the first line address period may be a time period greater than or equal to the length of the drive pulses of a particular waveform, and the first line address period may be a time period prescribed by a particular waveform.

In operation 1414, a second signal is provided to the display device 24. In response to the second signal, the display device 24 addresses a row of the display matrix 26 corresponding with the currently selected row. In addition, in response to the second signal, the display device 24 addresses the selected row for a second line address period. In contrast to the first line address period, the second line address period may be a time period that is shorter than the length of the drive pulses of a particular waveform.

After the operation 1410, an operation 1412 is performed. In operation 1412, a third signal may be provided to the display power module 38. In response to the third signal, the display power module 38 provides pixel data in the form of a drive impulse to one or more display pixels of the currently addressed row of the display matrix 26 via the column driver 44. Drive pulses are driven to one or more of the display pixels of the current row while the row is addressed for the first line address period.

After the operation 1414 has begun, an operation 1416 may be performed. In operation 1416, pixel data is deprived from the display pixels of the current row while it is addressed for the second line address period.

After the operations 1410-1412 or 1414-1416, an operation 1418 is performed. In operation 1418, a count of selected rows of the display matrix 26 is incremented. An operation 1420 next determines whether the incremented count exceeds the final number of rows of the display matrix 26. If the count does not exceed the final number of rows of the display matrix 26, the flow 1400 proceeds to operation 1406, where a current row is selected. On the other hand, if the count exceeds the final number of rows of the display matrix 26, the flow 1400 proceeds to an operation 1422, where the exemplary operational flow 1400 for a final display frame is stopped.

Addressing lines of a final drive frame according to the operational flow 1400 may save power or may permit a subsequent update operation to begin sooner, or both.

Figure 15:
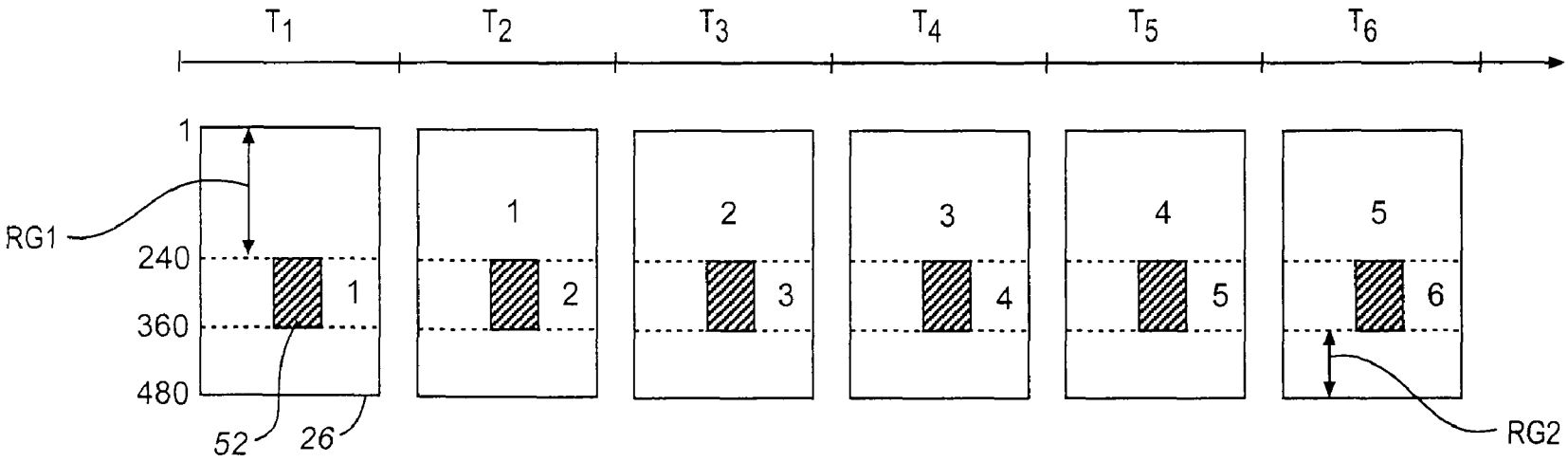
FIG. 15 depicts the operational flow of FIG. 13 applied to a sequence of drive frames in a waveform.

FIG. 15 depicts a sequence of drive frames in a waveform. In particular, the FIG. 15 depicts the operational flows 1200, 1300, and 1400 applied to the first and final drive frames in the waveform sequence. The particular waveform in this example comprises six drive frames. According to methods that do not incorporate the operational flows 1300 or 1400, the respective six drive frames take place time periods T1-T6, each line of each frame being addressed for the first line address period. The drive frames are represented graphically by six display matrices 26, each display matrix including a submatrix 52. The exemplary display matrix 26 has 480 lines. The first line address of the submatrix 52 is line 240. The last line address of the submatrix 52 is line 360. A first display matrix 26 is shown at time T1. The lines 1-239 represent a first group of lines RG1.

According to operational flow 1300, each line in the first group of lines RG1 of the T1 display matrix is selected for the second line address period. Beginning with line 240 of the T1 display matrix each line is selected for the first line address period according to operational flow 1300. As described above, the second line address period may be shorter than the first line address period. Each of the lines 1-480 of the display matrices shown at times T2-T5 is selected for the first line address period according to operational flow 1200. In addition, each of the lines 1-360 of the display matrix shown at time T6 is selected for the first line address period according to operational flow 1400.

The time that elapses between line 240 of the T1 display matrix and line 239 of the T2 display matrix may be viewed as corresponding with a first drive frame period for the submatrix 52 (labeled "1" in FIG. 15). Similarly, the time that elapses between line 240 of the T2 display matrix and line 239 of the T3 display matrix may be viewed as corresponding with a second drive frame period for the submatrix 52 (labeled "2" in the figure), and so on. When viewed in this manner, it can be seen that the drive pulses for submatrix 52 are spaced apart by equal time intervals, which satisfies the requirements of the typical waveform.

Each of the lines 361-480 (shown in FIG. 15 as RG2) of the display matrix shown at time T6 may be selected for the first line address period. However, according to the operational flow 1400, each of the lines 361-480 of the display matrix shown at time T6 may be selected for the second line address period. In another alternative, the lines of row group RG2 are not selected. As mentioned, addressing lines of a final drive frame following the last line of the submatrix 52 for the second line address period, or not addressing lines of a final drive frame following the last line of the submatrix 52 may save power or may permit a subsequent update operation to begin sooner, or both.

Referring to FIG. 7, in one embodiment, the timing generator 86 may sequentially addresses each row of the display matrix starting from an initial row and ending in a final row. The timing generator 86 may address each row for one of first or second line address period before addressing a next sequential row according to operational flows 1200, 1300, and 1400. In addition, the timing generator 86 may cause, for each sequentially addressed row of the display matrix 26, drive pulses to be driven to one or more of the display pixels 40 of a sequentially addressed row while the row is being addressed if the row is within the submatrix 52. The timing generator 86 may also cause, for each sequentially addressed row of the display matrix 26, display pixels of a sequentially addressed row to be deprived of drive pulses while the row is being addressed if the row is outside of the submatrix 52. Moreover, the timing generator 86, when sequentially addressing rows of the display matrix, may exclude particular rows of a first or final drive frame if an initial row value is set to a value other than the first row of the display matrix or if a final row value is set to a value other than the last row of the display matrix.

In one embodiment, two or more row drivers 42*a*, 42*b* may be wired together according to a known daisy-chain wiring scheme 45, as shown in FIG. 3. Each of the plural row drivers may have n outputs. Where two or more row drivers 24 are arranged in a known daisy-chain wiring scheme, a first row driver addresses a first output line of on receipt of a line clock signal. Upon receipt to each additional line clock signal, the output line of the row driver that is addressed will be incremented. As line clock signals are received, the count may begin with a first line of a first row driver 42*a* and then proceed sequentially up to the $n^{th}$ line of the first row driver 42*a*. According to the daisy-chain wiring scheme, the first line of a second row driver 42*b* is selected on the line clock signal immediately following the selection of the $n^{th}$ line of the first row driver 42*a*. The count then proceeds sequentially up to the $n^{th}$ line of the second row driver 42*b*. If a third row driver is included in the daisy-chain arrangement, the first line of the third row driver is selected on the line clock signal immediately following the selection of the $n^{th}$ line of the second row driver. The incrementing of output lines continues in this manner for each daisy-chained row driver until the $n^{th}$ line of the last row driver is reached, whereupon the count may be reset to the first line of the first row driver.

In one embodiment, the display device 24 includes two or more daisy-chained row drivers, and a known daisy-chain wiring scheme is adapted to bypass at least one of the two or more row drivers. For example, the display device 24 may include row drivers 42*a*, 42*b*. In one embodiment, when a partial display update is to be performed on a submatrix 52, the first line address of a submatrix 52 is identified. If the first line address of a submatrix 52 is identified as being included in one of the outputs of the second row driver 42*b*, it is determined that the first row driver 42*a* may be bypassed. In a partial display update operation of the submatrix 52, the first row driver 42*a* is bypassed and the addressing of lines may begin with the first line of the second row driver 42*b*. The operational flow 1300 may be applied to lines of the display matrix following the $n^{th}$ line of row driver 42*a*.

In one embodiment in which the display device 24 includes two or more daisy-chained row drivers, the line addressing of a final drive frame may be modified to take advantage of a situation where all of the line addresses of a submatrix 52 are included in the outputs of one of the row drivers. For example, if the last line address of a submatrix 52 is included in the outputs of the row driver 42*a*, then the row driver 42*b* may be bypassed in the final drive frame. In other words, only the outputs of the row driver 42*a* would be selected in the final drive frame. The operational flow 1400 may be applied to lines of the display matrix preceding the $n^{th}$ line of row driver 42*a*.

Figure 18:
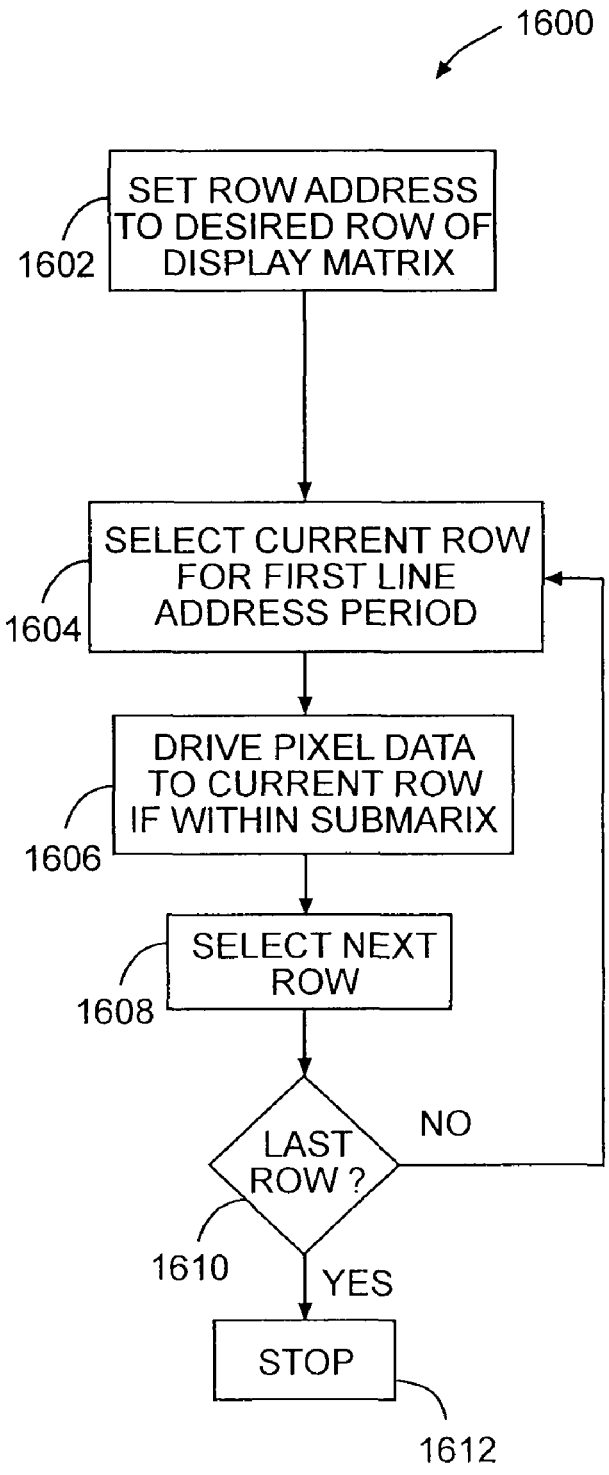
FIG. 18 depicts an operational flow for a partial display update according to one embodiment.

In alternative embodiments, a display device 124 may be provided with one or more row drivers 142 that are operable to address (or select) any desired row select line 46. As mentioned, a conventional row driver operates by selecting a first line, and then sequentially selecting successive lines on subsequent clock pulses. A conventional row driver, however, is not operable to select any desired line at random. In contrast to conventional row drivers, FIG. 18 shows a row driver 142, according to one embodiment, that is operable to randomly select any desired row of a display matrix 26, and to sequentially select successive row select lines 46 beginning with the selected line.

The row driver 142 includes an STL input upon which a desired initial line number may be placed. Like a conventional row driver, the row driver 142 includes a plurality of row select lines 46 for selecting particular rows R1-Rn of the display matrix 26. In one exemplary embodiment, the row driver includes 240 row select lines 46. More or fewer row select lines may be provided. Each of the lines 46 is coupled with an instance of an output enable logic block 144. The output enable logic blocks 144 are coupled with an output enable input (OE). The output enable logic blocks 144 operate to allow values stored in respective registers (R1-Rn) of a register group 146 to pass to the display matrix 26 when the output enable signal is asserted. In one embodiment, the register group 146 is a shift register. In one exemplary embodiment, the register group 146 includes 240 registers, one for each of the row select lines 46. The individual registers are coupled with a respective one of outputs 148 of a demultiplexer 150. The row driver 142 includes a U/D, CLK, and STV inputs in addition to the STL and OE inputs.

In operation, a signal is placed on the U/D input to select a counting direction, i.e., up or down. The OE input is asserted. A value that will be driven on a selected line is placed on the STV input, e.g. a voltage corresponding to a logic "1." The desired initial line number is placed on the STL input. With these signals active, the clock signal (CLK) is asserted. On the rising edge of the clock signal, the value on STV is transferred to the register specified on the STL input; and the value on STV is transferred to the corresponding row select line 46 from the specified register. The signal on the corresponding line 46 is maintained for the duration of a line address period. Subsequently, the value placed on the STV input is removed (e.g., replaced with a logic "0") and a next CLK is asserted. On receipt of the next CLK, the shift register 146 transfers the STV value from the previously selected register to the next sequential register and copies the STV value from the next sequential register to a corresponding row select line 46.

As an example, assume an initial line number of 200 is placed on the STL input. Also assume that U/D input specifies counting down. On a first CLK, the STV value is transferred to register R200. In addition, the STV value is copied from register R200 to the row select line 46 corresponding with row 200. On the second CLK, the STV value is transferred from register R200 to register R201 and the STV value is then copied from register R201 to a row select line 46 corresponding with row 201. Accordingly, the row driver 142 sequentially selects successive row select lines 46, beginning with a line specified on the STL input. Thereafter, each time a CLK signal is received, a next successive line is selected. In this alternative, the display controller 28 or another device may specify the STL input for starting a scan at any particular row.

FIG. 19 is schematic diagram of the internal logic of an exemplary register Rx of the register group 146. The exemplary register Rx includes AND gates 152, 154, OR gate 156, and latch 158. The AND gate 152 has a first input coupled with an adjacent register Rx−1 and a second input, which is an inverting input, coupled with U/D input. The AND gate 154 has a first input coupled with an adjacent register Rx+1 and a second input coupled with U/D input. The OR gate 156 has a first input coupled with the output 148 of a demultiplexer 150 associated with the register Rx. In addition, the OR gate 156 has second and third inputs respectively coupled with the outputs of the AND gates 152, 154. The output of OR gate 156 is coupled with a data input of a latch 158. The latch 158 also includes a clock input couple with CLK and an output with a row select line 46 via output enable logic 144. As an example, assume U/D is set to select from upper to lower, e.g., U/D=0. A logic "1" is placed on STV which will appear on the output 148 associated with register Rx. Both the input to AND gate 152 from adjacent register Rx−1 and the input to AND gate 154 from an adjacent register Rx+1 will be low. Thus, the second and third inputs to OR gate 156 will be low, while the first input will be high, resulting in a "1" being placed on the input of latch 158. A first CLK will transfer this "1" from the input to the output of latch 158. Subsequently, the "1" previously placed on the STV input is removed (e.g., replaced with a logic "0") and a second CLK is asserted. In the adjacent register Rx+1, there will be a "0" on the first input of an OR gate 156 coupled with the output 148 of a demultiplexer 150 associated with the register Rx+1. There will also be a "0" on the third input of OR gate 156 coupled with an adjacent register Rx+2. However, there will be a "1" on the second input of the OR gate 156 coupled with the adjacent register Rx, causing the output of OR gate 156 to go high. The second CLK will transfer this "1" from the input of OR gate 156 to the output of a latch 158 of register Rx+1. As this example illustrates, the shown logic is operable to repeatedly select a next sequential row select line following an initial selection of any desired row select line. While the shown logic is operable for select next sequential row select lines, one of ordinary skill in the art will appreciate that logic for selecting a next sequential row select line may be implemented in a variety of ways.

In one alternative embodiment, a row driver similar to the row driver 142 samples a line number on the STL input each time a line clock or vertical shift clock (CLK) signal is received. The row driver then drives the row select line 46 corresponding with the line number on the STL input. In this alternative, a display controller or other device explicitly specifies each line that the row driver is to select by placing a line number on the STL input. In this embodiment, a row driver may not require a demultiplexer and may not require logic for selecting a next sequential row select line. The row driver may include additional logic to ensure that timing requirements are satisfied.

In another alternative embodiment, a row driver similar to the row driver 142 couples the outputs 148 of the demultiplexer directly with the row select lines 46. In this embodiment, all or part of the register portion of the shift register may be eliminated, however, logic for selecting a next sequential row select line may be included. In addition, the row driver may include additional logic to ensure that timing requirements are satisfied.

Figure 16:
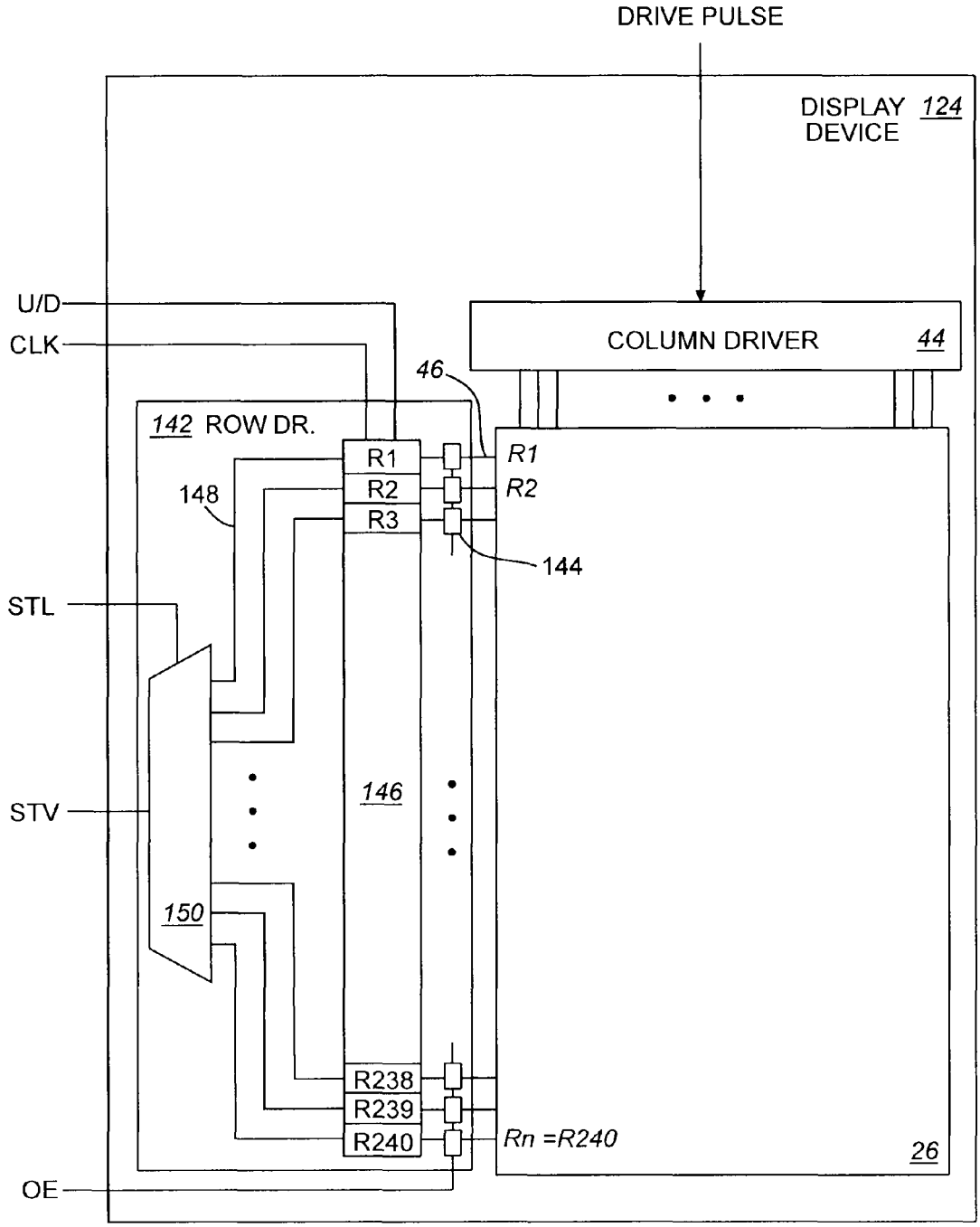
FIG. 16 depicts a display device according to one alternative embodiment, the display device being operable to address any desired row select line and including two or more registers.
Figure 17:
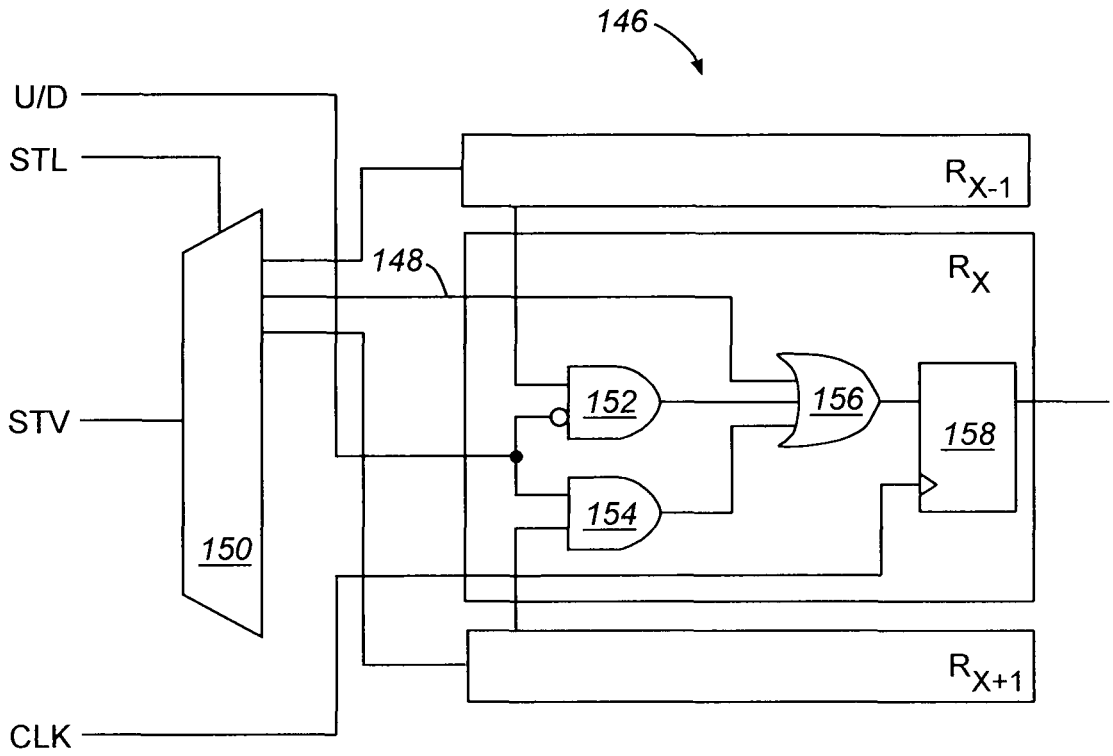
FIG. 17 depicts internal logic of one of the registers of FIG. 16.

FIG. 16 depicts an operation flow 1600 for a partial display update according to one embodiment. In particular, FIG. 16 illustrates an operational flow for selecting rows for driving pixel data using a display device that includes a row driver operable to randomly select any desired row of a display matrix 26. In operation 1602, the initial row value is provided to a row driver. The setting of the initial value may include transmitting any row address of the display matrix 26 from the display controller 28 to the display device. In addition, the setting of the initial value may include sampling a line number on an STL input of a row driver. In an operation 1604, a "current" row is selected for a first line address period. The current row may be the initial row value is provided to the row driver. The current row may be a row determined by logic for selecting a next sequential row select line. The current row may be a row that corresponds with the line number sampled from the STL input. The current row may be a row determined by incrementing (or decrementing) of a count of selected rows. The first line address period may be a time period greater than or equal to the length of the drive pulses of a particular waveform. In an operation 1606, if the current row is within the submatrix 52, pixel data in the form of a drive pulse is driven to one or more of the display pixels of the current row while the row is addressed for the first line address period. If the current row is not within the submatrix 52, the current row may be selected for the first line address period; pixel data may but need not be driven. In an operation 1608, a next row is selected. The operation 1608 may include receiving a line clock or a vertical clock (CLK) signal. The operation 1608 may include receiving a line number on a STL input. The operation 1608 may include an incrementing (or decrementing) of a count of selected rows of the display matrix 26. An operation 1610 may determine if the incremented count exceeds a final number of rows of the display matrix 26, e.g., Rn or R1. The operation 1610 may determine if the incremented count exceeds a final number of rows of a submatrix 52. If the count does not exceed the final row number, then the flow 1600 proceeds to operation 1604. On the other hand, if the count exceeds the number of rows of the display matrix 26, the flow 1600 proceeds to an operation 1612, where the exemplary operational flow 1600 is stopped.

In one embodiment, some or all of the operations and methods described in this description may be performed by hardware, software, or by a combination of hardware and software.

In one embodiment, some or all of the operations and methods described in this description may be performed by executing instructions that are stored in or on a computer-readable medium. The term "computer-readable medium" may include, but is not limited to, non-volatile memories, such as EPROMs, EEPROMs, ROMs, floppy disks, hard disks, flash memory, and optical media such as CD-ROMs and DVDs.

In this description, references may be made to "one embodiment" or "an embodiment." These references mean that a particular feature, structure, or characteristic described in connection with the embodiment is included in at least one embodiment of the claimed inventions. Thus, the phrases "in one embodiment" or "an embodiment" in various places are not necessarily all referring to the same embodiment. Furthermore, particular features, structures, or characteristics may be combined in one or more embodiments.

Although embodiments have been described in some detail for purposes of clarity of understanding, it will be apparent that certain changes and modifications may be practiced within the scope of the appended claims. Accordingly, the described embodiments are to be considered as illustrative and not restrictive, and the claimed inventions are not to be limited to the details given herein, but may be modified within the scope and equivalents of the appended claims. Further, the terms and expressions which have been employed in the foregoing specification are used as terms of description and not of limitation, and there is no intention in the use of such terms and expressions to exclude equivalents of the features shown and described or portions thereof, it being recognized that the scope of the inventions are defined and limited only by the claims which follow.

What is claimed is:

1. A method for updating a submatrix of a display matrix of a display device, comprising:

in a writing waveform comprised of multiple drive frames wherein all the rows of all the drive frames between the first and last drive frames are addressed, sequentially selecting rows of the display matrix starting from an initial row of the display matrix;

determining whether a selected row precedes the first row of the submatrix in the first drive frame of said writing waveform;

if a condition that a selected row precedes the first row of the submatrix in the first drive frame of the writing waveform is false, then addressing the selected row for a first line address period;

if a condition that a selected row precedes the first row of the submatrix in the first drive frame of the writing waveform is true, then addressing the selected row for a second line address period different from said first line address period;

determining whether the selected row follows the final row of the submatrix in the final drive frame of the writing waveform;

if a condition that a selected row follows the final row of the submatrix in the final drive frame of the writing waveform is false, then addressing the selected row for said first line address period; and if a condition that a selected row follows the final row of the submatrix in the final drive frame of the writing waveform is true, then addressing a selected row for said second line address period.

2. The method of claim 1, wherein the display device is active-matrix, electro-optic display device having display pixels having two or more stable display states, each display pixel requiring a series of voltage pulses regularly spaced in time to change its display state.

3. The method of claim 1, wherein the initial row of the display matrix is specified as the first row of the submatrix.

4. The method of claim 1, wherein the first line address period is a time period that is greater than the length of a drive pulse of the waveform.

5. The method of claim 1, wherein the second line address period is a time period that is shorter than the length of a drive pulse of the waveform.

6. The method of claim 1, wherein the final row of the display matrix is specified as the final row of the submatrix.

7. The method of claim 1, wherein the addressing a selected row for a first line address period includes driving pixel data to one or more of the display pixels of the row while the row is being addressed if the selected row is a row of the submatrix.

8. The method of claim 7, wherein the first line address period is a time period that is greater than the length of a drive pulse of the waveform.

9. The method of claim 1, wherein the addressing of a selected row for a second line address period includes depriving pixel data from the display pixels of the row while the row is being addressed.

10. The method of claim 9, wherein the second line address period is a time period that is shorter than the length of a drive pulse of the waveform.

11. The method of claim 1, wherein if a selected row is in a drive frame that is between the first and last drive frames of said writing waveform, then addressing the selected row for said first line address period.

12. The method of claim 11, wherein said second line address period is shorter than said first line address period.

13. The method of claim 12, wherein the same submatrix receives updating information in each drive frames of the writing waveform.

14. A display controller, comprising:

a first unit updating a submatrix of a display matrix of a display device, said updating of the submatrix including:

in a writing waveform comprised of multiple drive frames wherein all the rows of all the drive frames between the first and last drive frames are addressed, signal said display device to sequentially select rows of the display matrix starting from an initial row of the display matrix;

determine whether a selected row precedes the first row of the submatrix in the first drive frame of the writing waveform;

if a condition that the selected row precedes the first row of the submatrix in the first drive frame of the writing waveform is false, then signal the display device to address the selected row for a first line address period;

if a condition that a selected row precedes the first row of the submatrix in the first drive frame of the writing waveform is true, then signal the display device to address the selected row for a second line address period shorter than said first period;

determining whether the selected row follows the final row of the submatrix in the final drive frame of the writing waveform;

if a condition that a selected row follows the final row of the submatrix in the final drive frame of the writing waveform is false, then addressing the selected row for said first line address period;

if a condition that a selected row follows the final row of the submatrix in the final drive frame of the writing waveform is true, then addressing a selected row for said second line address period; and if the selected row is in a drive frame that is between the first and last drive frames of said writing waveform, then addressing the selected row for said first line address period.

15. The display controller of claim 14, wherein the display device is active-matrix, electro-optic display device having display pixels having two or more stable display states, each display pixel requiring a series of voltage pulses regularly spaced in time to change its display state.

16. The display controller of claim 14, wherein the initial row of the display matrix is specified as the first row of the submatrix.

17. The display controller of claim 14, wherein the final row of the display matrix is specified as the final row of the submatrix.

18. The display controller of claim 14, wherein the first unit controls the display device to deprive pixel data from the display pixels of a row being addressed for the second line address period.

19. The display controller of claim 14, wherein the second line address period is a time period that is shorter than the length of a drive pulse of the waveform.

20. The display controller of claim 14, wherein:

the first unit is operable to provide a particular row address of the display matrix to the display device, the particular row address defining a row of the display matrix; and the display device is operable to receive the particular row address and to address a row of the display matrix corresponding with the particular row address.

21. An active-matrix, electro-optic display device, comprising:

a display matrix having a plurality of display pixels, each of the display pixels having two or more stable display states, each display pixel requiring a series of voltage pulses regularly spaced in time to change its display state, the display matrix including a submatrix;

a row driver, the row driver operable to receive any row address of the display matrix and to address a row of the display matrix corresponding with the received row address; and a controller implementing the following steps:

in a writing waveform comprised of multiple drive frames wherein all the rows of all the drive frames between the first and last drive frames are addressed, signal the row driver to sequentially select rows of the display matrix starting from an initial row of the display matrix;

determine whether a selected row precedes a first row of the submatrix in the first drive frame of the waveform;

if a condition that a selected row precedes the first row of the submatrix in the first drive frame of the writing waveform is false, then signal the row driver to address the selected row for a first line address period;

if a condition that a selected row precedes the first row of the submatrix in the first drive frame of the writing waveform is true, then signal the row driver to address the selected row for a second line address period shorter than said first period;

determine whether a selected row follows the final row of the submatrix in the final drive frame of the writing waveform;

if a condition that a selected row follows the final row of the submatrix in the final drive frame of the writing waveform is false, then signal the row driver to address the selected row for the first line address period;

if a condition that a selected row follows the final row of the submatrix in the final drive frame of the writing waveform is true, then signal the row driver to address the selected row for the second line address period; and if a selected row is in a drive frame that lies between the first and last drive frames of said writing waveform, then signal the row driver to address the selected row for said first line address period.

* * * * *